US011289319B2

(12) United States Patent
Makarov et al.

(10) Patent No.: US 11,289,319 B2
(45) Date of Patent: Mar. 29, 2022

(54) SYSTEM TO ANALYZE PARTICLES, AND PARTICULARLY THE MASS OF PARTICLES

(71) Applicants: Thermo Fisher Scientific (Bremen) GmbH, Bremen (DE); California Institute of Technology, Pasadena, CA (US)

(72) Inventors: Alexander Makarov, Bremen (DE); Maria Reinhardt-Szyba, Hamburg (DE); Michael Roukes, Pasadena, CA (US)

(73) Assignees: Thermo Fisher Scientific (Bremen) GmbH, Bremen (DE); California Institute of Technology, Pasadena, CA (US)

( * ) Notice: Subject to any disclaimer, the term of this patent is extended or adjusted under 35 U.S.C. 154(b) by 328 days.

(21) Appl. No.: 16/533,221

(22) Filed: Aug. 6, 2019

(65) Prior Publication Data

US 2021/0043435 A1 Feb. 11, 2021

(51) Int. Cl.
*H01J 49/02* (2006.01)
*H01J 49/06* (2006.01)

(52) U.S. Cl.
CPC ..... *H01J 49/025* (2013.01); *H01J 49/067* (2013.01)

(58) Field of Classification Search
CPC .... G01N 29/022; H01J 49/025; H01J 49/067; G01P 15/097; G01P 15/123
See application file for complete search history.

(56) References Cited

U.S. PATENT DOCUMENTS

| | | | |
|---|---|---|---|
| 5,206,506 | A | 4/1993 | Kirchner |
| 6,722,200 | B2 | 4/2004 | Roukes |
| 6,762,406 | B2 | 7/2004 | Cooks |

(Continued)

FOREIGN PATENT DOCUMENTS

| | | |
|---|---|---|
| WO | 1996030930 | 10/1996 |
| WO | 2007055756 | 5/2007 |
| WO | 2016118821 | 7/2016 |

OTHER PUBLICATIONS

Kienitz, et al.,"Improved spatial separation of neutral molecules," Jul. 6, 2017.

(Continued)

*Primary Examiner* — Robert H Kim
*Assistant Examiner* — Hsien C Tsai
(74) *Attorney, Agent, or Firm* — ALG Intellectual Property, LLC

(57) ABSTRACT

The present invention relates to a system for analyzing particles, the system comprising: a NEMS device comprising at least one NEMS sensor for detecting particles impacting the at least one NEMS sensor, each NEMS sensor comprising a NEMS sensor area, a particle lens assembly, the particle lens assembly comprising at least one particle lens for focusing particles onto a NEMS sensor of the at least one NEMS sensor, wherein the particle lens assembly is spaced from the at least one NEMS sensor area by a separation distance, wherein the system is configured to sustain a space defined between the particle lens assembly and the NEMS device at a pressure where a mean free path for a reference particle is greater than the separation distance. The present invention also relates to a corresponding method.

19 Claims, 18 Drawing Sheets

(56) References Cited

U.S. PATENT DOCUMENTS

| | | | | |
|---|---|---|---|---|
| 7,302,856 | B2 | 12/2007 | Tang | |
| 7,330,795 | B2 | 2/2008 | Roukes | |
| 7,365,317 | B2 | 4/2008 | Whitehouse | |
| 7,411,187 | B2 | 8/2008 | Monroe | |
| 7,552,645 | B2 | 6/2009 | Bargatin | |
| 7,555,938 | B2 | 7/2009 | Bargatin | |
| 7,617,736 | B2 | 11/2009 | Tang | |
| 7,724,103 | B2 | 5/2010 | Feng | |
| 7,772,564 | B2 | 8/2010 | Kruit | |
| 8,044,556 | B2 | 10/2011 | Masmanidis | |
| 8,227,747 | B2 | 7/2012 | Roukes | |
| 8,329,452 | B2 | 12/2012 | Roukes | |
| 8,350,578 | B2 | 1/2013 | Sadek | |
| 8,791,409 | B2 | 7/2014 | Makarov | |
| 9,016,125 | B2 | 4/2015 | Andreucci | |
| 9,347,815 | B2 | 5/2016 | Roukes | |
| 2009/0261241 | A1 | 10/2009 | Roukes | |
| 2010/0003421 | A1* | 1/2010 | Ebels | B81C 99/0085 427/532 |
| 2014/0156224 | A1* | 6/2014 | Roukes | G01N 5/02 702/181 |
| 2018/0005809 | A1 | 1/2018 | Roukes | |

OTHER PUBLICATIONS

Ruz, et al.,"Physics of Nanomechanical Spectrometry of Viruses," Sci Reports Aug. 13, 2014.

Sage, et al.,"Neutral particle mass spectrometry with nanomechanical systems," Nature Communications | 6:6482 | DOI: 10.1038/ncomms7482 |www.nature.com/naturecommunications, Mar. 10, 2015.

Israelachvili, "Intermolecular and surface forces" revised third edition, 2011 (ISBN-10: 0123919274; ISBN-13:978-0123919274).

International Search Report and Written Opinion dated Oct. 14, 2020 in corresponding International Application No. PCT/EP2020/071824 with the International Filing Date of Aug. 3, 2020.

Sage, et al., "Single-particle Mass Spectrometry with arrays of frequency-addressed nanomechanical resonators", Nat Commun 9, 3283 (2018), https://doi.org/10.1038/s41467-018-05783-4.

Vigne, et al., "Optimization of an electron impact ion source on a MEMS time-of-flight mass spectrometer", https://doi.org/10.1016/j.snb.2016.11.083, Sensors and Actuators B: Chemical vol. 243, May 2017, pp. 690-695.

* cited by examiner

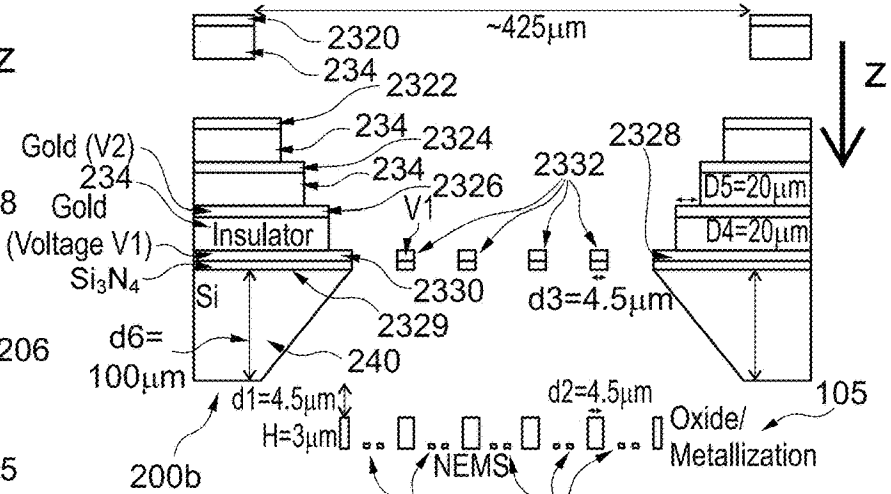
Fig. 15b
z
~425µm
2320
234
2322
2324
2326
V1
2330
2329
240
2328
D5=20µm
D4=20µm
105
Oxide/
Metallization
d3=4.5µm
d2=4.5µm
1048
NEMS
Insulator
Si
d1=4.5µm
H=3µm
d6=
100µm
200b
Gold (V2)
Gold
(Voltage V1)
$Si_3N_4$

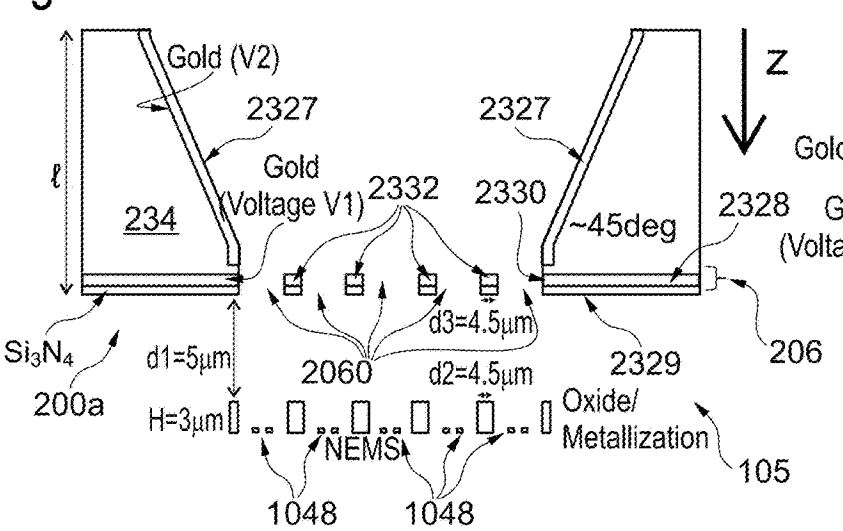
Fig. 15a
z
Gold (V2)
2327
Gold
Voltage V1)
234
2328
206
~45deg
2329
105
Oxide/
Metallization
2330
d3=4.5µm
d2=4.5µm
2332
2060
NEMS
1048
d1=5µm
H=3µm
$Si_3N_4$
200a
ℓ

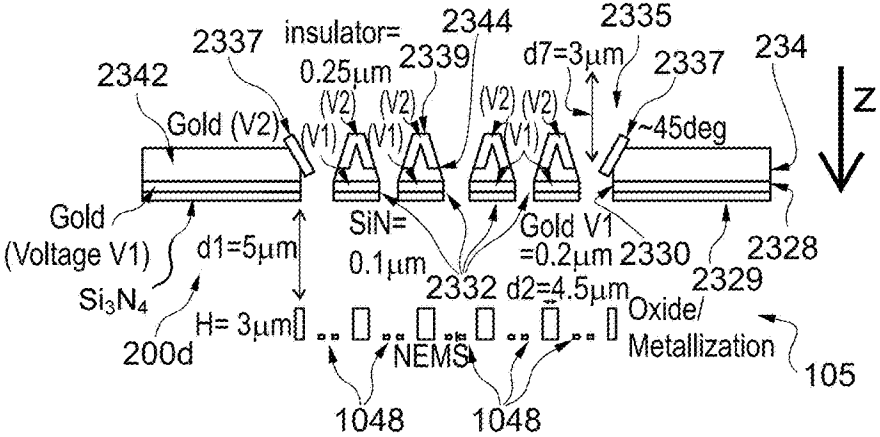
Fig. 15d
z
234
2328
2329
105
Oxide/
Metallization
2337
~45deg
2335
d7=3µm
2330
Gold V1
=0.2µm
2344
2339
(V2)
(V1)
insulator=
0.25µm
SiN=
0.1µm
2332
d2=4.5µm
NEMS
1048
2342
Gold (V2)
d1=5µm
H= 3µm
Gold
(Voltage V1)
$Si_3N_4$
200d

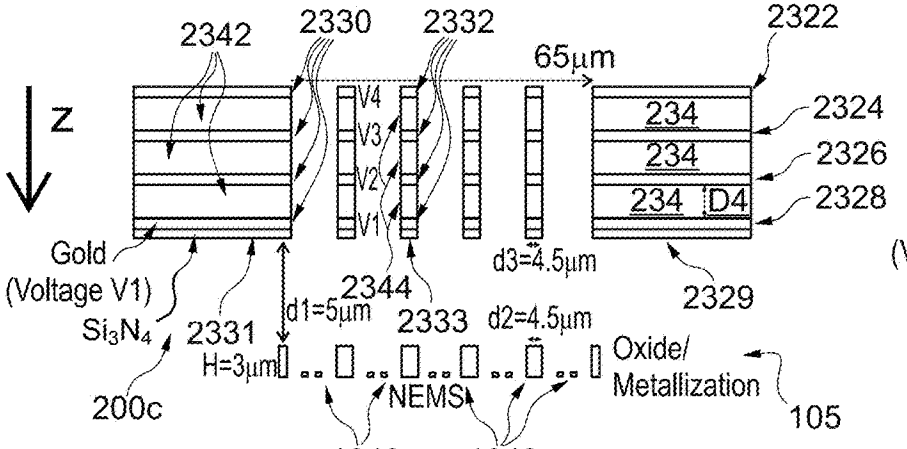
Fig. 15c
z
2322
2324
2326
2328
234
D4
2329
105
Oxide/
Metallization
65µm
d3=4.5µm
d2=4.5µm
2332
2333
2344
V4
V3
V2
V1
NEMS
1048
2330
d1=5µm
H=3µm
2342
2331
Gold
(Voltage V1)
$Si_3N_4$
200c

SYSTEM TO ANALYZE PARTICLES, AND PARTICULARLY THE MASS OF PARTICLES

The present invention generally relates to the analysis of particles, and particularly to measuring the mass of particles.

BACKGROUND INFORMATION

There are different technologies to analyze particles. One technology is known as mass spectrometry. In mass spectrometry, in essence, the particles to be analyzed are ionized. The ionized particles travel through an electromagnetic field. Their deflection by the electromagnetic field depends on their mass-to-charge ratio. By determining their position after the electromagnetic field, one can thus determine the mass-to-charge ratio of the particles.

In other words, conventional mass spectrometry (MS) enables identification of analytes by first charging them within an ion source, and then by tracking their induced motion in applied electromagnetic fields. This enables deduction of their mass-to-charge ratio. Since its first applications to organic compounds, MS has assumed an increasingly important role in the life sciences and medicine. Recently, it has become a preeminent technology for proteomic analysis. The increased resolution and mass range of modern mass analyzers now enable MS measurements of high-mass protein complexes and even virus capsids—in the mass range up to 1-50 MDa. These high-mass analytes are introduced into MS ion optics using nanospray at so-called native conditions (i.e. at a pH close to that of physiological conditions). For example, it was shown in U.S. Pat. No. 8,791,409 that the Orbitrap mass spectrometry enables detection of individual ions of protein complexes, with mass resolving power in the thousands range. However, conventional MS typically shows rapidly decreasing performance at higher masses, especially because of overlapping charge distributions of heterogeneous MDa analytes.

A new approach of mass spectrometry is based on systems of nanotechnology. This approach uses nanoelectromechanical systems (NEMS) resonators. NEMS resonators are electronically controllable, submicron-scale mechanical resonators, that enable analyte mass detection with very high sensitivity. Upon adsorption onto a NEMS resonator, an individual analyte can precipitously and measurably downshift the resonant frequency of the device. Embedding the NEMS resonator in specialized electronic circuitry permits real-time readout of individual molecular adsorption events. The frequency change induced by individual molecular adsorption events is proportional to both the mass of the molecule and the specific location the analyte adsorbs upon the resonator. Technical solutions enabling this technology can be found, for example, in U.S. Pat. Nos. 6,722,200, 7,302,856; 7,330,795; 7,552,645; 7,555,938; 7,617,736; 7,724,103; 8,044,556; 8,329,452, 8,350,578; 9,016,125.

These developments have been applied to ultra-sensitive mass detection of biomolecules as initially described in U.S. Pat. Nos. 6,722,200 and 8,227,747. They have recently culminated in mass resolution at the single-molecule level as shown in US2014/156224, where simple spectra have been assembled by statistical analysis from only a few hundred molecular adsorption events. One challenge for single-molecule analysis is the fact that the resonant frequency shift induced by analyte adsorption depends upon both the mass of the analyte and its precise location of adsorption upon the NEMS resonator. This may be solved by continuous tracking, that is, exciting and detecting two vibrational modes of the resonator. Analysing the different frequency shifts an analyte induces upon two vibrational modes permits both unknowns—mass and position-of-adsorption—to be deduced; this methodology is described in US2014/156224. A mass resolution of 50-100 kDa has already been demonstrated.

In contrast to conventional MS, the technology based on NEMS has sensitivity and resolving power that continues to improve with increasing analyte mass. This can prove useful for analysis of high-mass, intact, and native species.

In U.S. Pat. No. 9,347,815, a nanospray ion source and MS atmosphere-to-vacuum interface were used together to facilitate NEMS-based detection and mass analysis. An alternative method for analyte introduction was also demonstrated, involving the use of a matrix-assisted laser desorption and ionization source. Cooling the NEMS sensor enhances non-specific physical adsorption of the arriving analytes onto the surface of the devices. In U.S. Pat. No. 9,347,815 it is shown that a mass spectrum representing the entire heterogeneous sample can be constructed by individually measuring the mass of sequentially-arriving analyte particles.

In other words, in the described approach NEMS (nanoelectromechanical system) resonators are used for the detection of mass spectra, and the NEMS resonators are electronically controllable, submicron-scale mechanical resonators. Due to the adsorption of molecules a downshift of the resonant frequency of the device can be observed. Aspects of these technology are described in U.S. Pat. Nos. 6,722,200 and 8,227,747. US 2014/0156224 and WO2016/118821A1 describe further details of this technology. The mass of single molecules can be determined for any adsorption event of a molecule and mass spectra can be assembled by statistical analysis from a few hundred adsorption events. With the analysis of different frequency shifts in two vibrational modes for each molecule the mass of each molecule can be deduced. The investigated sample are ionized, e.g., by a nanospray ion source and transferred via an atmosphere-to-vacuum interface into a vacuum chamber, where they are adsorbed on a NEMS detector. Thus, a mass spectrum representing the entire heterogeneous sample can be constructed by individually measuring the mass of sequentially arriving analyte particles.

While the use of NEMS systems to analyze samples and to detect particles in a sample may be promising, there are still certain drawbacks and limitations related to the use of NEMS systems. While an individual NEMS sensor may in principle detect a single particle, the detection limit in NEMS systems may be a lot higher, i.e., one may need substantially more than one particle in a sample to detect the presence of such a particle. That is, when embedded in known NEMS systems, the sensitivity of the technology is far from optimal.

SUMMARY

In light of the above, it is an object of the present invention to overcome or at least alleviate the shortcomings and disadvantages of the prior art. More particularly, it is an object of the present invention to provide a NEMS system, method and corresponding use being improved with regard to sensitivity and detection threshold.

These objects are met by the present invention.

In a first embodiment, the present invention relates to a system. The system is configured for analyzing particles. The system comprises a NEMS device comprising at least one NEMS sensor for detecting particles impacting the at least one NEMS sensor, each NEMS sensor comprising a NEMS sensor area. That is, the NEMS device comprises at least one NEMS sensor area. The system further comprises a particle lens assembly, the particle lens assembly comprising at least one particle lens for focusing particles onto a NEMS sensor area of the at least one NEMS sensor. The particle lens assembly is spaced from the at least one NEMS sensor area by a separation distance. Further, the system is configured to maintain a space defined between the particle lens assembly and the NEMS device at a pressure where a mean free path for a reference particle is greater than the separation distance.

It will be understood that the particles may be ions. It will further be understood that NEMS denotes nanoelectromechanical system.

That is, as discussed, in particular, the system comprises a particle lens assembly, e.g., an ion lens assembly. The ion lens assembly is typically configured and located to focus the ions onto each of the NEMS sensor areas and more particularly onto each of the NEMS target areas.

It has been found that the NEMS sensors only have a limited target area allowing for ideal detection of particles. Only if particles land on such a limited target area, will they be detected. Typically, the target area only is a fraction of the area of the NEMS sensor area, e.g., only a few percent or even less. If not focusing the particles onto the NEMS target area, the majority of the particles will not impact on the target area and will thus not be detected. By means of the proposed technology, it is possible to suitably focus the particles onto the NEMS target area. Thus, a substantially higher portion of the particles may impact on the NEMS target area, e.g., this may increase the fraction impacting onto the NEMS target area by one or more orders of magnitude. Thus, the sensitivity is substantially increased and the detection limit is substantially reduced.

Further, it will be understood that such a particle lens assembly is typically located before or "upstream" of the NEMS device, i.e., the particles are first guided through the particle lens assembly and then to the NEMS device. Further, the NEMS device and more particularly the NEMS sensor area is spaced from the particle lens assembly by a certain separation distance.

Furthermore, in the present system, the space defined between the particle lens assembly and the NEMS device may also be held at a reduced pressure fulfilling certain requirements. More particularly, the pressure may be chosen so that a mean free path of a reference particle is greater (and preferably substantially greater) than the separation distance.

The reference particle may be one particle of the class of particles to be analyzed. For example, when one intends to analyze proteins, the reference particle may be a protein and preferably a protein with a large size (and thus a comparatively low mean free path).

When reference is herein made to the mean free path, the momentum dissipation mean free path is meant, which can be calculated as $$MFP = \frac{M + m}{m \cdot n \cdot S}$$

where

MFP is the mean free path;

M is the mass of the reference particle;

m is the mass of the gas particle;

n is the concentration of the gas; and

S is the collisional cross section of the reference particle with one particle of the gas.

It will be understood that the gas particle refers to the type of gas present in the space between the particle lens assembly and the NEMS device. An exemplary gas is air or $N_2$. When the gas, which may also be referred to as the background gas, is known, the mean free path depends on the collisional cross section of the reference particle with the gas particle (i.e., $S=\pi(r_{ref}+r_{gas})^2$ where $r_{ref}$ is the radius of the reference particle and $r_{gas}$ is the radius of the gas particle (in the approximation of spherical shape of both types of particles) and further on the concentration and thus on the pressure of the gas.

The pressure is set so that the mean free path for the reference particle is larger and preferably substantially larger than the separation distance. Thus, it is ensured that (at least most of) the particles travel freely from the particle lens to the NEMS device and focusing follows laws of ion optics in vacuum. This further contributes to the particles being guided to the relatively small target area, as the particles do not collide with the gas particles and do thus not change their direction in response to such collisions.

Further, the reference particle will typically be chosen to be a large particle of the respective class of particles (e.g., a large protein in case the particles to be detected are proteins). This ensures that the mean free path is sufficiently long for all particles to be detected.

It has been found that the low sensitivity of known NEMS detectors is caused by an extremely small collection efficiency for incident particles, such as ions. The invention is addressing this problem by applying a particle lens assembly, e.g., an ion optical lens assembly in front of the NEMS detectors. The beam of the incident particles, e.g., ions may be splitted into narrow beamlets and focused on the NEMS detector area by positioning a microlens in front of each NEMS detector. More particularly, an array of microlenses may be arranged in front of an array of NEMS detectors. One parameter of the technology is the distance between the micro lenses and the NEMS detector surface, which may be only a few to a few tens of micrometers. This kind of focusing upon nanotechnical structures by micro lenses may be particularly advantageous.

In other words, embodiments of the invention may greatly increase a nanosensor's capture efficiency for analytes, in particular for charged analytes. An ion optical micro-lens, which may be fabricated by methods including nano/micro system technologies, may be placed in front of a nanoelectromechanical sensor (NEMS) for single-molecule measurements, thereby increasing the capture rate of ionized molecules incident from an external ion source.

In still other words, although NEMS-based inertial mass sensors have a good ability to directly detect the inertial mass of physisorbed analytes, they typically provide only an extremely small capture cross section for species incident upon them. For example, a biomolecular ion beam within quadrupole ion guides of a conventional mass spectrometer will have cross sectional diameter typically of order 1 mm. An individual NEMS sensor, with capture area of order several $\mu m^2$, when placed in-line with such a source will only capture approximately one in $10^5$ of the analytes incident upon it. However increasing the physical size of the devices generally results in decreased performance for inertial mass sensing. However, the proposed technology, by focusing the particles onto the NEMS target area, massively increases the portion of particles that can be analysed.

Generally, one concept discussed herein is that a greatly increased capture cross section can be realized by using a particle lens assembly, e.g., by using electrostatics: incoming analyte flux is deflected away from areas on the sensor that are insensitive and, instead, focused precisely upon active areas of the device that provide highest mass sensitivity. This can be accomplished by ion optics at the "sensor pixel" level—in effect, splitting the incoming broad beam into narrow beamlets, each focused by micro-lenses positioned in front of the NEMS sensor. According to one concept, one micro-lens per individual NEMS sensor is used. The micro-lenses can be fabricated with the processing steps of nano- and micro-systems technologies known in the art.

The particle lens assembly may include parallel particle lenses, such as parallel ion lenses. Such parallel particle lenses have already been described, e.g., in WO2007/055756, U.S. Pat. Nos. 7,772,564, 7,411,187, 6,762,406, 5,206,506, and U.S. Pat. No. 7,365,317.

The at least one NEMS sensor may be a plurality of NEMS sensors.

Thus, a plurality of measurements may be done in parallel, increasing the efficiency of the system.

The at least one particle lens may be a plurality of particle lenses and each particle lens may be configured and located to focus particles onto a NEMS sensor associated with the particle lens.

Each NEMS sensor of the at least one NEMS sensor may comprise a NEMS substrate, at least one NEMS resonator, and a circumferential section, wherein the NEMS substrate and the NEMS resonator are comprised by the NEMS sensor area.

Particles travelling from the particle lens assembly to the NEMS device may define a z-direction.

The circumferential section may be located in front of the NEMS substrate and the NEMS resonator in the z-direction and may be distanced from these elements by a height.

The height may be in the range of 0.5 μm to 6 μm, preferably 1 μm to 4 μm, such as 1.5 μm to 3.5 μm.

The NEMS sensor area may have an area, the area preferably being in the range of $(2\ \mu m)^2$ to $(15\ \mu m)^2$, further preferably $(5\ \mu m)^2$ to $(11\ \mu m)^2$, such as $(8\ \mu m)^2$ to $(9\ \mu m)^2$.

The NEMS sensors may be arranged in a NEMS array.

The NEMS array may comprise (2×2) to (1000×1000) NEMS sensors, preferably (3×3) to (100×100) NEMS sensors, such as (4×4) to (10×10) NEMS sensors.

This may allow for a suitable parallelization of simultaneous measurements.

The NEMS array may have an area in the range of $(10\ \mu m)^2$ to $(1{,}000\ \mu m)^2$, preferably $(20\ \mu m)^2$ to $(300\ \mu m)^2$, such as $(50\ \mu m)^2$ to $(100\ \mu m)^2$.

The particle lens assembly may be an electrostatic particle lens assembly and may contain a preliminary lens for the entire beam followed by a particle lens array corresponding to the NEMS array.

The electrode forming the particle lens array may comprise a circumferential portion of the preliminary lens and mesh portions.

The NEMS device may be separated from the particle lens assembly by a distance in the range of 1 μm to 20 μm, preferably 2 μm to 10 μm, such as 3 μm to 7 μm.

The preliminary particle lens assembly may have a length along the z-direction, which length preferably is in the range of 50 μm to 500 μm, further preferably 100 μm to 300 μm, such as 150 μm to 250 μm.

The electrodes may be formed of metal such as gold, molybdenum, gold-coated aluminum, etc.

The preliminary particle lens assembly may further comprise a insulating $Si_3N_4$ layer, wherein the $Si_3N_4$ layer is located between the NEMS device and the electrode closest to the NEMS device.

The $Si_3N_4$ layer may comprise a circumferential portion and mesh portions.

The thickness of the $Si_3N_4$ layer may be in the range of 20 nm to 300 nm, preferably 50 nm to 150 nm, such as 100 nm.

The electrodes of the preliminary lens may define an aperture, wherein, in a cross-sectional view, the aperture has a maximum extension and a minimum extension.

Thus, the particles coming from a previous stage may be focused from an initial maximum extension to a minimum extension and further towards the NEMS device.

The maximum extension of the preliminary lens may be in the range of 200 μm to 1,000 μm, preferably 300 μm to 500 μm, such as 400 μm to 450 μm, and wherein the minimum extension may be in the range of 20 μm to 200 μm, further preferably 40 μm to 150 μm, such as 50 μm to 80 μm.

The aperture may be successively reduced from the first to the last electrode, i.e., along the z-direction.

In a cross-sectional view, each electrode of the preliminary lens may be protruding, with respect to the preceding electrode, by a distance of 5 μm to 50 μm, preferably 10 μm to 30 μm, such as 15 μm to 25 μm.

The complete system may comprise 3 to 25, preferably 5 to 15, such as 8 to 12 electrodes.

Each electrode may comprise a thickness along the z-direction of 50 nm to 500 nm, preferably 100 nm to 300 nm, such as 150 nm to 250 nm.

The system may further comprise at least one insulator located between the electrodes.

The at least one insulator may be formed of parylene or SU8.

Each insulator may comprise a thickness along the z-direction of 5 μm to 50 μm, preferably 10 μm to 30 μm, such as 15 μm to 25 μm.

The shape of each insulator may correspond to an electrode in contact with the insulator.

The particle lens assembly may further comprise a support located between the NEMS device and the electrode closest to the NEMS device.

The support may have a length along the z-direction, wherein the length is in the range of 10 μm to 200 μm, preferably 50 μm to 250 μm, such as 100 μm.

The support may be formed of Si.

The support may widen along the z-direction.

The particle lens assembly may comprise a tapering electrode.

The tapering electrode may taper along the z-direction.

The tapering electrode may comprise an overall ring shape, i.e. the tapering may generate an overall conus shape.

The tapering electrode may comprise an overall square shape, i.e. the tapering may generate an overall frustum shape.

The tapering angle, with respect to the z-direction, of the tapering electrode may be in the range of 30° to 60°, preferably 40° to 50°, such as 45°.

All electrodes and all of the at least one insulator may comprise respective circumferential portions and respective mesh portions.

The electrodes may have the same shape and size in a plane perpendicular to the z-direction.

The system may comprise a forward electrode, located more forward in the z-direction than the electrode forming the particle lens array.

The forward electrode may comprise a length in the z-direction.

The length of the forward electrode may be in the range of 1 μm to 10 μm, preferably 1.5 μm to 5 μm, such as 3 μm.

The forward electrode may comprise a peripheral portion and mesh portions.

The peripheral portion of the forward electrode may taper in the z-direction at an angle in the range of 30° to 60°, preferably 40° to 50°, such as 45°.

The mesh portions, in a cross-sectional view, may be provided at an angle in the range of 30° to 60°, preferably 40° to 50°, such as 45°.

That is, in a cross-sectional view, the mesh portion follows a general V-shape.

The thickness of the insulator may be in the range of 0.1 μm to 5 μm, preferably 0.2 μm to 0.5 μm, such as 0.25 μm.

The electrodes may be supplied with different voltages.

The system may be configured to focus a particle beam onto the at least one NEMS sensor such that at least 50% of particles reaching the NEMS sensor impact the NEMS sensor in an area of $(2\ \mu m)^2$, preferably in an area of $(1\ \mu m)^2$, such as in an area of $(0.5\ \mu m)^2$.

Thus, a substantial portion of the particles may be focused onto the target area, substantially increasing the portion of particles that can be detected by the system. This may thus substantially increase the sensitivity and decrease the detection limit.

The system may be configured to focus a particle beam onto the at least one NEMS sensor such that at least 50% of particles reaching the NEMS sensor impact the NEMS sensor in an area that is smaller than 20% of a cross-sectional area of the particle lens assembly, preferably smaller than 10% of this cross-sectional area, most preferably smaller than 1% of this cross-sectional area.

The system may further comprise an ion source for ionizing the particles.

It may be particularly advantageous that the particles are ionized, as this may facilitate the focusing of the particles by means of an electrostatic particle lens assembly.

The system may further comprise an atmosphere-to-vacuum interface to transfer particles from atmospheric pressure to a reduced pressure.

The system may further comprise a first mass analyzer.

The first mass analyzer (20) is selected from a group consisting of an ion-trap mass analyzer (such as an Orbitrap™ analyzer, a cylindrical ion trap, or a quadrupole ion trap mass analyzer); an ion cyclotron resonance mass analyzer, e.g., a Fourier transform ion cyclotron resonance mass analyzer; a time-of-flight mass analyzer; an electrostatic trap mass analyzer; a quadrupole mass analyzer; a magnetic sector mass analyzer; and an electrostatic sector mass analyzer. Also ion mobility spectrometer of trapping or continuous-beam type could be used.

The system may further comprise a second mass analyzer.

The second mass analyzer may be selected from the group recited above.

The system may further comprise a third mass analyzer.

The third mass analyzer may be selected from the group recited above.

The system may also comprises at least one further, and preferably at least 3 further mass analyzers.

The system may further comprise an ion storage device such as a C-trap.

The system further may comprise a collision cell.

The atmosphere-to-vacuum interface may be located downstream of the ion source; the C-trap may be located downstream of the atmosphere-to-vacuum interface; the mass analyzer may be located downstream of the C-trap, thus defining a first branch downstream of the C-trap; the collision cell may be located downstream of the C-trap, thus defining a second branch downstream of the C-trap; and the particle lens assembly and the NEMS device may be located downstream of the collision cell.

The system may be configured to maintain the space defined between the particle lens assembly and the NEMS device at a pressure where a mean free path for the reference particle is more than 5 times greater than the separation distance, preferably more than 10 times, further preferably more than 50 times, and still further preferably more than 100 times.

Such mean free paths may be particularly advantageous so that particles will not collide with particles in the background gas after the lens assembly. This will again increase the portion of particles that are focused onto the target area.

The separation distance may be in the range of 1 μm to 20 μm, preferably 3 μm to 15 μm, such as 5 μm to 10 μm.

The quotient of the height of the NEMS sensor and its size across the sensor area (or to the square root of the area of the NEMS sensor area) may be in the range of 0.1 to 1, preferably 0.2 to 0.5, such as 0.3 to 0.5.

The quotient of the separation distance and the size of NEMS sensor across its area may be in the range of 0.3 to 50, preferably 0.5 to 2, such as 0.8 to 1.2.

The quotient of the separation distance and the square root of the area of the NEMS sensor area may be in the ranges defined in the preceding paragraph. This quotient may also be in the range of 0.5 to 20, such as 0.5 to 2.

The quotient of the maximum extension and the minimum extension may be in the range of 2 to 20, preferably 4 to 10, such as 5 to 8.

The quotient of the length of the particle lens assembly and the separation distance may be in the range of 2 to 50, preferably 10 to 40, such as 20 to 30.

The system may be configured to maintain the space defined between the particle lens assembly and the NEMS device at an absolute pressure not higher than $10^{-3}$ mbar, preferably not higher than $10^{-4}$ mbar, further preferably below $10^{-5}$ mbar, such as below $10^{-9}$ mbar. That is, some embodiments of the present technology may employ ultra high vacuum.

The system may further comprise an alignment mechanism configured to alter the position of the particle lens assembly relative to the NEMS device.

The alignment mechanism may have an accuracy below 2 μm, preferably below 1 μm, such as in the range of 0.01 μm to 1 μm.

The alignment mechanism may be configured to alter the position of the particle lens assembly relative to the NEMS device in 2 or 3 directions.

The alignment mechanism may comprise piezoelectric and/or mechanical translational elements.

Generally, the described technology may combine micro lenses with a hybrid instrument based on NEMS devices in combination with ion-optics based MS instrumentation.

The present invention also relates to a method to analyze particles, the method comprising utilizing the system according to any of the preceding embodiments.

The method may have advantages corresponding to the advantages discussed above with regard to the system.

The method may comprise focusing particles onto the at least one NEMS sensor by means of the particle lens assembly.

The method may comprise focusing particles onto each of the plurality of NEMS sensors by means of the plurality of particle lenses.

For each NEMS sensor, at least 50% of the particles may be focused onto an area of $(2\ \mu m)^2$, preferably onto an area of $(1\ \mu m)^2$, such as onto an area of $(0.5\ \mu m)^2$.

The focusing of particles may comprise at least 50% of particles reaching the NEMS sensor impacting the NEMS sensor in an area that is smaller than 20% of a cross-sectional area of the particle lens assembly, preferably smaller than 10% of this cross-sectional area, most preferably smaller than 1% of this cross-sectional area.

The method may comprise applying a first combination of voltages to the electrodes, resulting in a first focal point on the at least one NEMS sensor area; and applying a second combination of voltages to the electrodes, the second combination of voltages being different from the first combination of voltages, resulting in a second focal point on the at least one NEMS sensor area, the second focal point being spatially shifted relatively to the first focal point.

That is, the present method also allows the focal points to be changed and to be set by means of the voltages. As different modes of the NEMS pixels may have different ideal impact areas, this may result in still better results.

In a plane perpendicular to the z-direction, the first focal point and the second focal point may be separated by a distance between 0.1 μm and 10 μm, preferably 0.5 μm and 5 μm. First and second focal points might reside on the same NEMS sensor or they could belong to physically different NEMS sensors.

The method may comprise applying a voltage combination to the plurality of electrodes and thereby decreasing a velocity of particles along the z-direction.

The particles may be decelerated to an average velocity along the z-direction below 10,000 m/s, preferably below 5,000 m/s, such as below 1,000 m/s.

The particles may be decelerated to a kinetic energy which is smaller than 2,000 times the thermal energy per charge, preferably smaller than 1,000 times the thermal energy per charge, further preferably smaller than 500 times the thermal energy per charge, such as smaller than 100 times the thermal energy per charge.

The method may comprise applying a voltage to the electrodes and thereby removing particles located on the at least one NEMS sensor area.

That is, the present technology also allows particles that have impacted the NEMS sensor to be subsequently removed from the NEMS sensor and to be used in further detection techniques. In other words, one aspect of the present technology also relates to the use of the particle lens assembly (e.g., the microlens array). Here, by applying another voltage to the electrodes of the microlenses the investigated particles (e.g., molecules) can be desorbed from the NEMS detector by electrostatic desorption.

The method may comprise analyzing the particles by an additional instrument different from the NEMS device after removing the particles from the NEMS sensor.

The additional instrument may be a mass analyzer.

The method may comprise defining a reference particle; and maintaining the space defined between the particle lens assembly and the NEMS device at a pressure where a mean free path for the reference particle is greater than the separation distance.

The space defined between the particle lens assembly and the NEMS device may be maintained at a pressure where a mean free path for the reference particle is more than 5 times greater than the separation distance, preferably more than 10 times, further preferably more than 50 times, and still further preferably more than 100 times.

The method may further comprise altering the position of the particle lens assembly relative to the NEMS device.

The position of the particle lens assembly with regard to the NEMS device may be altered in 2 or 3 directions (i.e., dimensions).

Altering the position of the particle lens assembly relative to the NEMS device may result in an increase of particles per time reaching the NEMS sensor area.

The increase may be at least 10-fold, preferably at least 100-fold, such as at least 1,000-fold.

In other words, embodiments of the present technology thus also relate to calibrating the particle lens assembly relative to the NEMS device to maximize the number of particles incident on the "sweet spot" of the NEMS device.

The present invention also relates to a use of the discussed system for the discussed method.

In the use, the mass of particles may be determined on the basis of measurements by the NEMS device and measurements by the mass analyzer measurements.

The discussed system may be configured to carry out the discussed method accordingly.

That is, generally, the present technology relates to a system, a method and a corresponding use. The technology is for analyzing particles, such as molecules. The technology may comprise creating a stream of molecules, and analyzing said molecules using an electromechanical device at pressures substantially below atmospheric, so that said device measurably changes one of its characteristics upon adsorption of a single molecule to be analyzed. The capture efficiency of the incoming stream of molecules may be substantially improved by locating a microscale electrostatic lens, which focuses molecules onto the desired adsorption site on the device.

The molecules may be charged in an ion source. The ion source may utilize a electrospray.

An inner size of the particle lens assembly, e.g., the electric lens, may be at least a) 5, b) 10, or c) 50 times bigger than the size of the adsorption site. Again, this exemplifies how much the particles may be focused by the present technology.

The present invention is also defined by the following numbered embodiments.

Below, system embodiments will be discussed. System embodiments are abbreviated with the letter "S" followed by a number. Whenever reference is herein made to system embodiments, these embodiments are meant.

S1. A system (1) for analyzing particles, the system (1) comprising

- a NEMS device (100) comprising at least one NEMS sensor (104) for detecting particles impacting the at least one NEMS sensor (104), each NEMS sensor (104) comprising a NEMS sensor area (1044),
- a particle lens assembly (200), the particle lens assembly (200) comprising at least one particle lens (2060) for focusing particles onto a NEMS sensor (104) of the at least one NEMS sensor area (1044),
- wherein the particle lens assembly (200) is spaced from the at least one NEMS sensor area (1044) by a separation distance (D),
- wherein the system (1) is configured to maintain a space defined between the particle lens assembly (200) and the NEMS device (100) at a pressure where a mean free path for a reference particle is greater than the separation distance (D).

It will be understood that the particles may be ions. It will further be understood that NEMS denotes nanoelectromechanical system.

S2. The system (1) according to the preceding embodiment, wherein the at least one NEMS sensor (104) is a plurality of NEMS sensors (104).

S3. The system (1) according to the preceding embodiment, wherein the at least one particle lens (2060) is a plurality of particle lenses (2060) and wherein each particle lens (2060) is configured and located to focus particles onto a NEMS sensor area (1044) associated with the particle lens (2060).

S4. The system (1) according to any of the preceding embodiments, wherein each NEMS sensor (104) of the at least one NEMS sensor (104) comprises a NEMS substrate (1046), at least one NEMS resonator (1048), and a circumferential section (1043), wherein the NEMS substrate (1046) and the NEMS resonator (1048) are comprised by the NEMS sensor area (1044).

S5. The system (1) according to any of the preceding embodiments, wherein particles travelling from the particle lens assembly (200) to the NEMS device (100) define a z-direction.

S6. The system according to the preceding embodiment and with the features of the penultimate embodiment, wherein the circumferential section (1043) is located in front of the NEMS substrate (1046) and the NEMS resonator (1048) in the z-direction and distanced from these elements by a height (H).

S7. The system (1) according to the preceding embodiment, wherein the height (H) is in the range of 0.5 μm to 6 μm, preferably 1 μm to 4 μm, such as 1.5 μm to 3.5 μm.

S8. The system (1) according to any of the preceding embodiments, wherein the NEMS sensor area (1044) has an area, the area preferably being in the range of $(2\ \mu m)^2$ to $(15\ \mu m)^2$, further preferably $(5\ \mu m)^2$ to $(11\ \mu m)^2$, such as $(8\ \mu m)^2$ to $(9\ \mu m)^2$.

S9. The system (1) according to any of the preceding embodiments and with the features of embodiment S2, wherein the NEMS sensors (104) are arranged in a NEMS array (105).

S10. The system according to the preceding embodiment, wherein the NEMS array (105) comprises (2×2) to (1000×1000) NEMS sensors, preferably (3×3) to (100×100) NEMS sensors, such as (4×4) to (10×10) NEMS sensors.

S11. The system according any of the 2 preceding embodiments, wherein the NEMS array (105) has an area in the range of $(10\ \mu m)^2$ to $(1{,}000\ \mu m)^2$, preferably $(20\ \mu m)^2$ to $(300\ \mu m)^2$, such as $(50\ \mu m)^2$ to $(100\ \mu m)^2$.

S12. The system according to any of the preceding embodiments, wherein the particle lens assembly (200) is an electrostatic particle lens assembly.

S13. The system according to any of the preceding embodiments, wherein the particle lens assembly (200) comprises an electrode system.

S14. The system according to the preceding embodiment, wherein the electrode system comprises a plurality of electrodes.

S15. The system according to any of the 2 preceding embodiments and with the features of embodiments S3 and S9, wherein the electrode system comprises an electrode (2328) forming a particle lens array (206) corresponding to the NEMS array (105).

S16. The system according to the preceding embodiment, wherein the electrode (2328) forming the particle lens array (206) comprises a circumferential portion (2330) and mesh portions (2332).

S17. The system according to any of the preceding embodiments, wherein the NEMS device (100) is separated from the particle lens assembly (200) by a distance (d1) in the range of 1 μm to 20 μm, preferably 2 μm to 10 μm, such as 3 μm to 7 μm.

S18. The system according to any of the preceding embodiments and with the features of embodiment S5, wherein the particle lens assembly (200) has a length along the z-direction, which length preferably is in the range of 50 μm to 500 μm, further preferably 100 μm to 300 μm, such as 150 μm to 250 μm.

S19. The system according to any of the preceding embodiments with the features of embodiment S14, wherein the electrodes are formed of metal such as gold, molybdenum, and/or gold-coated aluminum.

S20. The system according to any of the preceding embodiments with the features of embodiments S14, wherein the particle lens assembly (200) further comprises a $Si_3N_4$ layer, wherein the insulating $Si_3N_4$ layer is located between the NEMS device (100) and the electrode closest to the NEMS device.

S21. The system (1) according to the preceding embodiments, wherein the $Si_3N_4$ layer (2329) comprises a circumferential portion (2330) and mesh portions (2332).

S22. The system (1) according to any of the 2 preceding embodiments, wherein the thickness of the $Si_3N_4$ layer (2329) is in the range of 20 nm to 300 nm, preferably 50 nm to 150 nm, such as 100 nm.

S23. The system (1) according to any of the preceding embodiments with the features of embodiment S14, wherein the electrodes define an aperture, wherein, in a cross sectional view, the aperture has a maximum extension and a minimum extension.

S24. The system according to the preceding embodiment, wherein the maximum extension is in the range of 200 μm to 1,000 μm, preferably 300 μm to 500 μm, such as 400 μm to 450 μm, and preferably wherein the minimum extension is in the range of 20 μm to 200 μm, further preferably 40 μm to 150 μm, such as 50 μm to 80 μm.

S25. The system (1) according to the any of the 2 preceding embodiments and with the features of embodiment S5, wherein the aperture is successively reduced from the first to the last electrode (232), i.e., along the z-direction.

S26. The system (1) according to the preceding embodiment, wherein in a cross-sectional view, each electrode (232) is protruding, with respect to the preceding electrode (232), by a distance (D5) of 5 μm to 50 μm, preferably 10 μm to 30 μm, such as 15 μm to 25 μm.

S27. The system according to any of the preceding embodiments and with the features of embodiment S14, wherein the system comprises 3 to 25, preferably 5 to 15, such as 8 to 12 electrodes.

S28. The system according to any of the preceding embodiments with the features of embodiment S5 and S14, wherein each electrode comprises a thickness along the z-direction of 50 nm to 500 nm, preferably 100 nm to 300 nm, such as 150 nm to 250 nm.

S29. The system according to any of the preceding embodiments with the features of embodiment S14, wherein the system further comprises at least one insulator (234) located between the electrodes.

S30. The system according to the preceding embodiment, wherein the at least one insulator is formed of parylene or SU8.

S31. The system according to any of the 2 preceding embodiments and with the features of embodiment S5, wherein each insulator comprises a thickness along the z-direction of 5 μm to 50 μm, preferably 10 μm to 30 μm, such as 15 μm to 25 μm.

S32. The system according to any of the 3 preceding embodiments, wherein the shape of each insulator corresponds to an electrode in contact with the insulator.

S33. The system (1) according to any of the preceding embodiments with the features of embodiment S14, wherein the particle lens assembly (200) further comprises a support (240) located between the NEMS device (100) and the electrode closest to the NEMS device.

S34. The system (1) according to the preceding embodiment and with the features of embodiment S5, wherein the support (240) has a length (d6) along the z-direction, wherein the length (d6) is in the range of 10 μm to 200 μm, preferably 50 μm to 250 μm, such as 100 μm.

S35. The system according to any of the 2 preceding embodiments, wherein the support (240) is formed of Si.

S36. The system according to any of the 3 preceding embodiments and with the features of embodiment S5, wherein the support (240) widens along the z-direction.

S37. The system (1) according to any of the preceding embodiments with the features of embodiment S14, wherein the particle lens assembly (200) comprises a tapering electrode (2327).

S38. The system (1) according to the preceding embodiment and with the features of embodiment S5, wherein the tapering electrode (2327) tapers along the z-direction.

S39. The system (1) according to the preceding embodiment, wherein the tapering electrode (2327) comprises an overall ring shape, i.e. the tapering generates an overall conus shape.

S40. The system (1) according to the penultimate embodiment, wherein the tapering electrode (2327) comprises an overall square shape, i.e. the tapering generates an overall frustum shape.

S41. The system according to the 4 preceding embodiments, wherein the tapering angle, with respect to the z-direction, of the tapering electrode (2327) is in the range of 30° to 60°, preferably 40° to 50°, such as 45°.

S42. The system (1) according to embodiment S16 and including the features of embodiment S14 and S29, wherein all electrodes (232) and all of the at least one insulator (234) comprise respective circumferential portions (2330) and respective mesh portions (2332).

S43. The system (1) according to the preceding embodiment and with the features of embodiment S5, wherein the electrodes (232) have the same shape and size in a plane perpendicular to the z-direction.

S44. The system (1) according to any of the preceding embodiments and with the features of embodiments S5 and S15, wherein the system (1) comprises a forward electrode (2335), located more forward in the z-direction than the electrode (2328) forming the particle lens array (206).

S45. The system (1) according to the preceding embodiment, wherein the forward electrode (2328) comprises a length (d7) in the z-direction.

S46. The system (1) according to the preceding embodiment, wherein the length (d7) of the forward electrode (2328) is in the range of 1 μm to 10 μm, preferably 1.5 μm to 5 μm, such as 3 μm.

S47. The system (1) according to the preceding embodiment, wherein the forward electrode (2328) comprises a peripheral portion (2337) and mesh portions (2339).

S48. The system (1) according to the preceding embodiment, wherein the peripheral portion (2337) of the forward electrode (2335) tapers in the z-direction at an angle in the range of 30° to 60°, preferably 40° to 50°, such as 45°.

S49. The system (1) according to any of the two preceding embodiments, wherein the mesh portions (2339), in a cross-sectional view, are provided at an angle in the range of 30° to 60°, preferably 40° to 50°, such as 45°.

That is, in a cross-sectional view, the mesh portion (2339) follows a general V-shape.

S50. The system (1) according to the preceding embodiment and including the features of embodiments S29, wherein the thickness of the insulator (234) is in the range of 0.1 μm to 5 μm, preferably 0.2 μm to 0.5 μm, such as 0.25 μm.

S51. The system (1) according to any of the preceding embodiments with the features of embodiment S14, wherein the electrodes (232) are supplied with different voltages.

S52. The system (1) according to any of the preceding embodiments, wherein the system (1) is configured to focus a particle beam onto the at least one NEMS sensor (104) such that at least 50% of particles reaching the NEMS sensor impact the NEMS sensor (104) in an area of $(2\ \mu m)^2$, preferably in an area of $(1\ \mu m)^2$, such as in an area of $(0.5\ \mu m)^2$.

S53. The system (1) according to any of the preceding embodiments, wherein the system (1) is configured to focus a particle beam onto the at least one NEMS sensor (104) such that at least 50% of particles reaching the NEMS sensor impact the NEMS sensor (104) in an area that is smaller than 20% of a cross-sectional area of the particle lens assembly (200), preferably smaller than 10% of this cross-sectional area, most preferably smaller than 1% of this cross-sectional area.

S54. The system (1) according to any of the preceding embodiments, wherein the system (1) further comprises an ion source (2) for ionizing the particles.

S55. The system (1) according to any of the preceding embodiments, wherein the system further comprises an atmosphere-to-vacuum interface (30) to transfer particles from atmospheric pressure to a reduced pressure.

S56. The system (1) according to any of the preceding embodiments, wherein the system further comprises a first mass analyzer (20).

S57. The system according to the preceding embodiment, wherein the first mass analyzer (20) is selected from a group consisting of

- an ion-trap mass analyzer, such as
  - an Orbitrap™ analyzer,
  - a cylindrical ion trap, or
  - a quadrupole ion trap mass analyzer;
- an ion cyclotron resonance mass analyzer, e.g., a Fourier transform ion cyclotron resonance mass analyzer,
- a time-of-flight mass analyzer;
- an electrostatic trap mass analyzer;
- a quadrupole mass analyzer;
- a magnetic sector mass analyzer;
- an electrostatic sector mass analyzer; and
- an ion mobility spectrometer, such as
  - a trapping type ion mobility spectrometer or a continuous-beam type ion mobility spectrometer.

S58. The system according to any of the 2 preceding embodiments, wherein the system further comprises a second mass analyzer.

S59. The system according to the preceding embodiment, wherein the second mass analyzer is selected from the group recited in the penultimate embodiment.

S60. The system according to any of the 2 preceding embodiments, wherein the system further comprises a third mass analyzer.

S61. The system according to the preceding embodiment, wherein the third mass analyzer is selected from the group recited in S57.

S62. The system according to any of the 2 preceding embodiment, wherein the system comprises at least one further, and preferably at least 3 further mass analyzers.

S63. The system (1) according to any of the preceding embodiments, wherein the system further comprises an ion storage device, such as a C-trap (14).

S64. The system (1) according to any of the preceding embodiments, wherein the system further comprises a collision cell (16).

S65. The system according to any of the preceding embodiments and with the features embodiments S54, S55, S56, S63, and S64, wherein the atmosphere-to-vacuum interface (30) is located downstream of the ion source (2);

the C-trap (14) is located downstream of the atmosphere-to-vacuum interface (30);

the first mass analyzer (20) is located downstream of the C-trap (14), thus defining a first branch downstream of the C-trap;

the collision cell (16) is located downstream of the C-trap (14), this defining a second branch downstream of the C-trap;

and the particle lens assembly (200) and the NEMS device (100) are located downstream of the collision cell (16).

S66. The system according to any of the preceding embodiments, wherein the system is configured to maintain the space defined between the particle lens assembly (200) and the NEMS device (100) at a pressure where a mean free path for a reference particle is more than 5 times greater than the separation distance (D), preferably more than 10 times, further preferably more than 50 times, and still further preferably more than 100 times.

S67. The system according to any of the preceding embodiments, wherein the separation distance (D) is in the range of 2 μm to 20 μm, preferably 3 μm to 15 μm, such as 5 μm to 10 μm.

S68. The system according to any of the preceding embodiments with the features of embodiments S6 and S8, wherein the quotient of the area of the NEMS sensor area (1044) and the height (H) is in the range of 5 μm to 50 μm, preferably 10 μm to 30 μm, such as 15 μm to 20 μm.

S69. The system according to any of the preceding embodiments with the features of embodiments S8, wherein the quotient of the area of the NEMS sensor area (1044) and the separation distance (D) is in the range of 2 μm to 20 μm, preferably 3 μm to 15 μm, such as 5 μm to 10 μm.

S70. The system according to any of the preceding embodiments and with the features of embodiment S23, wherein the quotient of the maximum extension and the minimum extension is in the range of 2 to 20, preferably 4 to 10, such as 5 to 8.

S71. The system according to any of the preceding embodiments with the features of embodiment S18, wherein the quotient of the length of the particle lens assembly (200) and the separation distance is in the range of 2 to 50, preferably 10 to 40, such as 20 to 30.

S72. The system according to any of the preceding embodiments, wherein the separation distance (D) is in the range of 1 μm to 20 μm, preferably 2 μm to 15 μm, such as 5 μm to 10 μm.

S73. The system according to any of the preceding embodiments, wherein the system is configured to maintain the space defined between the particle lens assembly (200) and the NEMS device (100) at an absolute pressure in the range of not higher than $10^{-3}$, preferably not higher than $10^{-4}$ mbar, further preferably below $10^{-5}$ mbar, most preferably below $10^{-9}$ mbar.

S74. The system according to any of the preceding embodiments, wherein the system further comprises an alignment mechanism configured to alter the position of the particle lens assembly (200) relative to the NEMS device (100).

S75. The system according to the preceding embodiments, wherein the alignment mechanism has an accuracy below 2 μm, preferably below 1 μm, such as in the range of 0.01 μm to 1 μm.

S76. The system according to any of the 2 preceding embodiments, wherein the alignment mechanism is configured to alter the position of the particle lens assembly (200) relative to the NEMS device (100) in 2 or 3 directions.

S77. The system according to any of the 3 preceding embodiments, wherein the alignment mechanism comprises piezoelectric and/or mechanical translational elements.

Below, method embodiments will be discussed. Method embodiments are abbreviated with the letter "M" followed by a number. Whenever reference is herein made to method embodiments, these embodiments are meant.

M1. A method to analyze particles, the method comprising utilizing the system (1) according to any of the preceding embodiments.

M2. The method according to the preceding embodiment, wherein the method comprises focusing particles onto the at least one NEMS sensor (104) by means of the particle lens assembly (200).

M3. The method according to any of the preceding method embodiments, wherein the system (1) comprises the features of embodiment S3, the method further comprising focusing particles onto each of the plurality of NEMS sensors (104) by means of the plurality of particle lenses (2060).

M4. The method according to any of the preceding method embodiments, wherein, for each NEMS sensor (104), at least 50% of the particles are focused onto an area of $(2\ \mu m)^2$, preferably onto an area of $(1\ \mu m)^2$, such as onto an area of $(0.5\ \mu m)^2$.

M5. The method according to any of the preceding method embodiments with the features of embodiment M2, wherein the focusing of particles comprises at least 50% of particles reaching the NEMS sensor impacting the NEMS sensor (104) in an area that is smaller than 20% of a cross-sectional area of the particle lens assembly (200), preferably smaller than 10% of this cross-sectional area, most preferably smaller than 1% of this cross-sectional area.

M6. The method according to any of the preceding method embodiments, wherein the system comprises the features of embodiment S14, the method comprising applying a first combination of voltages to the electrodes, resulting in a first focal point on the at least one NEMS sensor area (1044);

applying a second combination of voltages to the electrodes, the second combination of voltages being different from the first combination of voltages, resulting in a second focal point on the at least one NEMS sensor (104), the second focal point being spatially shifted relatively to the first focal point.

M7. The method according to the preceding embodiment, wherein the system comprises the features of embodiment S5, wherein in a plane perpendicular to the z-direction, the first focal point and the second focal point are separated by a distance between 0.1 μm and 10 μm, preferably 0.5 μm and 5 μm.

M8. The method according to any of the preceding method embodiments, wherein the system comprises the features of embodiment S5 and S14, the method further comprising applying a voltage combination to the plurality of electrodes and thereby decreasing a velocity of particles along the z-direction.

M9. The method according to the preceding embodiment, wherein the particles are decelerated to an average velocity along the z-direction below 10,000 m/s, preferably below 5,000 m/s, such as below 1,000 m/s.

M10. The method according to any of the 2 preceding embodiments, wherein the particles are decelerated to a kinetic energy which is smaller than 2,000 times the thermal energy per charge, preferably smaller than 1,000 times the thermal energy per charge, further preferably smaller than 500 times the thermal energy per charge, such as smaller than 100 times the thermal energy per charge.

M11. The method according to any of the preceding method embodiments, wherein the system comprises the features of embodiment S14, the method further comprising applying a voltage to the electrodes and thereby removing particles located on the at least one NEMS sensor (104).

M12. The method according to the preceding embodiment, wherein the method further comprises analyzing the particles by an additional instrument different from the NEMS device (100) after removing the particles from the NEMS sensor.

M13. The method according to the preceding embodiment, wherein the additional instrument is a mass analyzer.

M14. The method according to any of the preceding embodiments, wherein the method comprises defining a reference particle;

maintaining the space defined between the particle lens assembly (200) and the NEMS device (100) at a pressure where a mean free path for the reference particle is greater than the separation distance (D).

M15. The method according to the preceding embodiment, wherein the space defined between the particle lens assembly (200) and the NEMS device (100) is maintained at a pressure where a mean free path for the reference particle is more than 5 times greater than the separation distance (D), preferably more than 10 times, further preferably more than 50 times, and still further preferably more than 100 times.

M16. The method according to any of the preceding method embodiments, wherein the system comprises the features of embodiment S74, wherein the method further comprises altering the position of the particle lens assembly (200) relative to the NEMS device (100).

M17. The method according to the preceding embodiment, wherein the system comprises the features of embodiment S76, wherein the position of the particle lens assembly (200) with regard to the NEMS device (100) is altered in 2 or 3 directions.

M18. The method according to any of the 2 preceding embodiments, wherein altering the position of the particle lens assembly (200) relative to the NEMS device (100) results in an increase of particles per time reaching the NEMS sensor area (1044).

M19. The method according to the preceding embodiment, wherein the increase is at least 10-fold, preferably at least 100-fold, such as at least 1,000-fold.

Below, use embodiments will be discussed. Use embodiments are abbreviated with the letter "U" followed by a number. Whenever reference is herein made to use embodiments, these embodiments are meant.

U1. Use of the system according to any of the preceding system embodiments for the method according to any of the preceding method embodiments.

U2. Use of the system according to the preceding embodiment, wherein the system comprises the features of embodiment S56, wherein mass of particles is determined on the basis of measurements by the NEMS device and measurements by the mass analyzer.

S74. The system according to any of the preceding system embodiments, wherein the system is configured for the method according to any of the preceding method embodiments.

BRIEF DESCRIPTION OF THE DRAWINGS

The present technology will now be described with reference to the accompanying drawings.

FIGS. 15*a* to 15*d* depict further cross-sectional views across a NEMS array and a micro lens assembly in accordance with further embodiments of the present technology;

DETAILED DESCRIPTION

Figure 1:
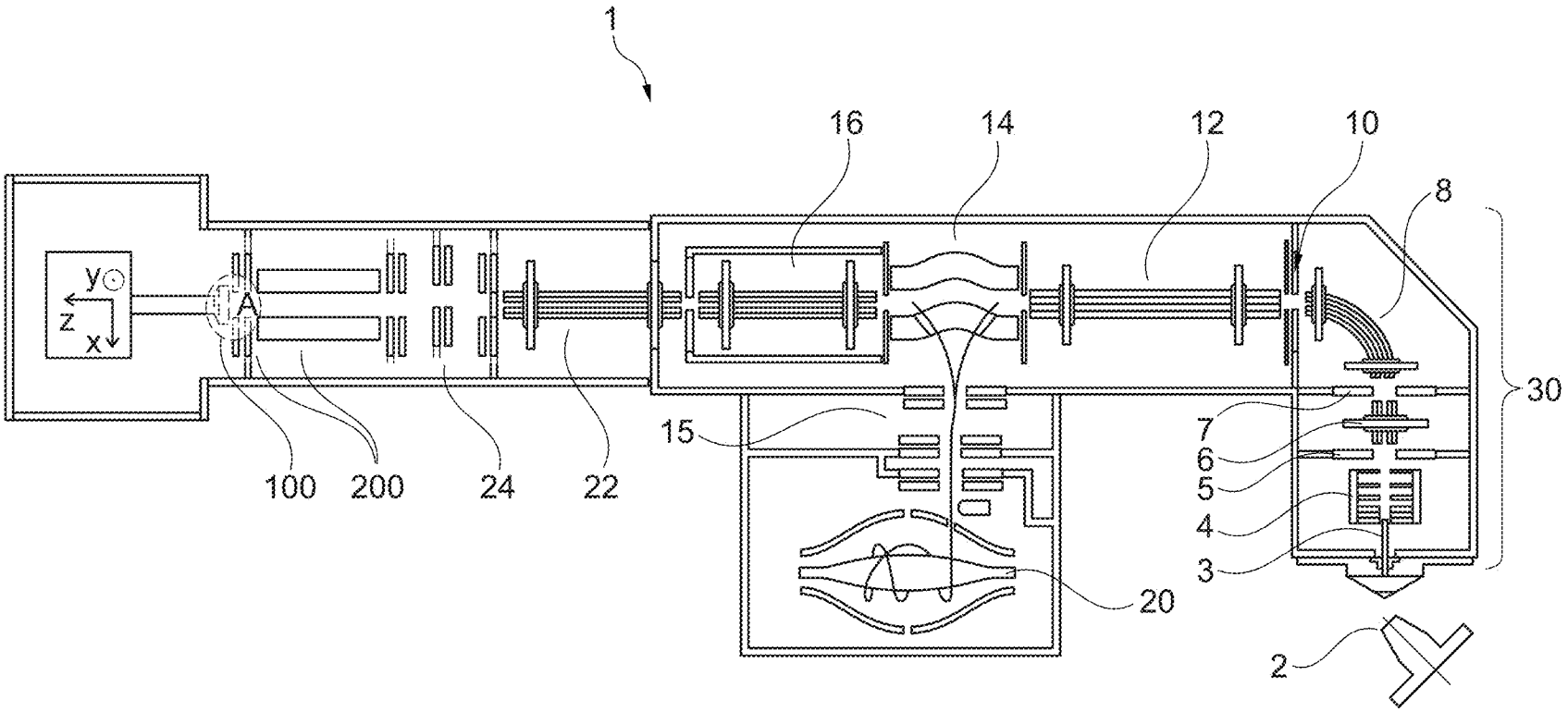
FIG. 1 depicts a system in accordance with an embodiment of the present technology.

FIG. 1 depicts a system 1 according to one embodiment of the present technology. In very general words, the system 1 comprises an ion source 2, an atmosphere-to-vacuum interface 30, and a NEMS device 100.

The ion source 2 may be located at atmospheric pressure. The ion source 2 may be of electrospray type. In some embodiments, the ion source 2 may be configured for atmospheric pressure ionization (API) and may thus also be referred to as an API source 2. It will be appreciated that other ion sources could be used. For example, the present technology could also be used for analysis of ions produced by matrix-assisted laser desorption/ionization (MALDI), laserspray or any other inlet ionization, or indeed any other techniques capable of producing high-m/z ions.

Ions from the electrospray pass through the atmosphere-to-vacuum interface 30. More particularly, the ions pass through a transfer capillary 3 to a stacked ring ion guide (S-lens) or ion funnel 4, through its exit lens 5, and then through an injection flatapole 6, an inter-flatapole lens 7, and a bent flatapole 8. The pressure in the region of the S-lens 4 to bent flatapole 8 is typically 1-10 mbar (e.g. 1.6 mbar). The bent flatapole 8 may have 2 mm gaps between its rods. Collisional cooling occurs in the bent flatapole 8 at pressures of $10^{-3}$ to $10^{-2}$ mbar.

In some embodiments, the system 1 may also comprise other elements, e.g., ion gate 10, quadrupole mass filter 12, an ion storage device (e.g., a C-trap 14), Z-lens 15, mass analyzer 20, and collision cell 16, details of which are also described in US2014/027629A1, which is incorporated by reference herein in its entirety. Such elements may allow the system 1 to also analyze particles by means of the mass analyzer 20, which may be, e.g., an Orbitrap™ mass analyzer.

In some embodiments, the system 1 may be based on an Q Exactive™ Plus instrument (Thermo Fisher Scientific (Bremen), Bremen, Germany) and may utilize an electrostatic trap in the form described in WO96/30930, which is realized in the Orbitrap™ mass analyzer provided by ThermoFisher Scientific Inc., Waltham, USA and its affiliates. In such embodiments, an ion gate 10 in the form of a fast split lens controls the entry of the ions into an RF-only transport multipole 12, which may be also replaced by a quadrupole mass filter and typically is held at a pressure less than $10^{-4}$ mbar. From the transport multipole the ions enter a C-trap 14 typically with a pressure therein of $(0.1\text{-}4.0)\times10^{-3}$ mbar (for example $0.5\times10^{-3}$ mbar). For further cooling, the ions may be passed into a collision cell 16, e.g., a gas-filled HCD cell 16 comprising RF multipole rods typically with a pressure of $(1\text{-}20)\times10^{-3}$ mbar (e.g. $5\times10^{-3}$ mbar). The HCD cell 16 may be separated from the C-trap 14 by a single diaphragm, which allows easy tuning of the HCD cell.

In some embodiments, the RF and axial field applied to the HCD cell 16 can be set to provide for fragmentation of ions therein. The HCD cell 16 allows better trapping while maintaining a certain pressure in the C-trap 14 and thus the Orbitrap™ mass analyzer, because the HCD cell 16 is i) longer and ii) at a higher pressure than the C-trap 14. Ions are injected from the C-trap 14 via a Z-lens 15 into the Orbitrap™ mass analyzer 20. The vacuum in the Orbitrap compartment is preferably below $7\times10^{-10}$ mbar although it is dependent on the pressure in the HCD cell 16. For some large proteins, pressures in excess of $2\times10^{-9}$ mbar could be used That is, in some embodiments, ions may be produced by an ion source 2 (e.g., a nanospray source) at atmospheric pressure preferably at native conditions, and are then transported through atmosphere-to-vacuum interface 30 into vacuum. Optionally, the ions may be mass selected by a multipole mass filter 12 (e.g., a quadrupole mass filter), and then introduced into a mass-to-charge analysis system, where a mass-to-charge spectrum is acquired by mass spectrometer as is known in the art. In the example illustrated in FIG. 1, an Orbitrap™ mass spectrometer 20 may be employed. However, other MS analyzers such as time-of-flight MS (TOF-MS), open or closed electrostatic traps (EST), or Fourier transform ion cyclotron resonance (FT-ICR) instruments could be used. In the embodiment with an Orbitrap™ mass analyzer shown in FIG. 1, biomolecular ions pass directly through the MS via components facilitating ion-optical transfer.

While in the above, an embodiment comprising a mass spectrometer 20 has been described, it will be understood that such a mass spectrometer 20 may be independent from the other features described below, and that other embodiments may not comprise such a mass spectrometer 20.

In general words, the exemplary system 1 may comprise an atmospheric-pressure ion source 2 and an atmosphere-to-vacuum interface 30. The atmosphere-to-vacuum interface 30 may comprise a capillary 3, an S-lens 4, an S-lens exit lens 5, an injection flatapole 6, an inter-flatapole lens 7, and a bent flatapole 8. Further, the system 1 may comprise an ion gate 10, a multipole mass filter 12 (e.g., a quadrupole mass filter), and an ion storage device, such as a C-trap 14. Further still, the system 1 may also comprise an MS analyser 20 (e.g., an Orbitrap™ mass analyzer). In addition to these components, the system according to the depicted embodiments of the present technology also comprises a NEMS device 100 in a differentially-pumped chamber behind the collision cell 16. By applying voltages to apertures of the C-trap 14, one may control the flow of particles to the MS analyser 20 and/or to the collision cell 16 and the NEMS device 100 containing one NEMS array.

Figure 2:
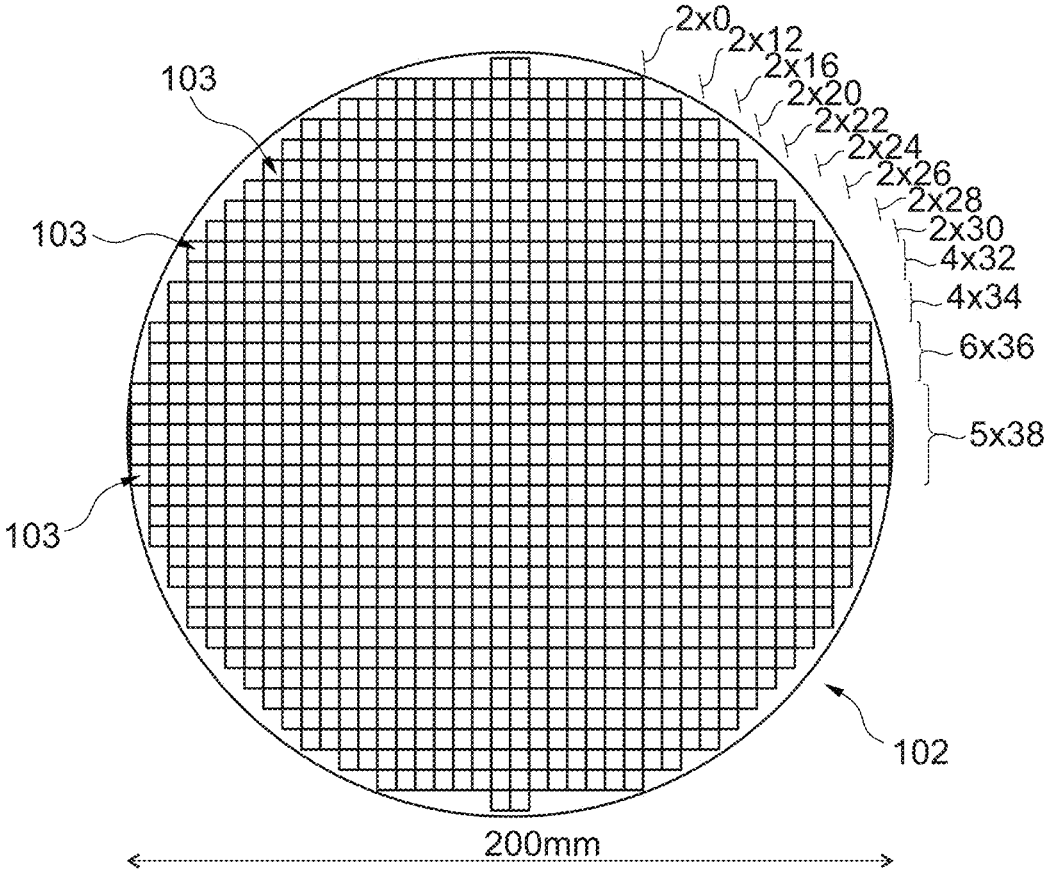
FIG. 2 depicts a wafer for producing a plurality of NEMS devices in accordance with embodiments of the present technology.

FIG. 2 depicts a wafer 102 for producing a plurality of NEMS devices 100. The wafer 102 may have a general round design with a diameter of approximately 200 mm. The wafer 102 may comprise a plurality of individual NEMS dies 103, such as 100 to 5,000 NEMS dies 103. In the depicted embodiment, the wafer 102 comprises 1,100 NEMS dies 103, only some of which have been identified with a reference numeral for simplicity of illustration. In the embodiment of FIG. 2, each NEMS die 103 has an area of 5 mm×5 mm. Each NEMS die 103 corresponds to one NEMS device 100.

Figure 3:
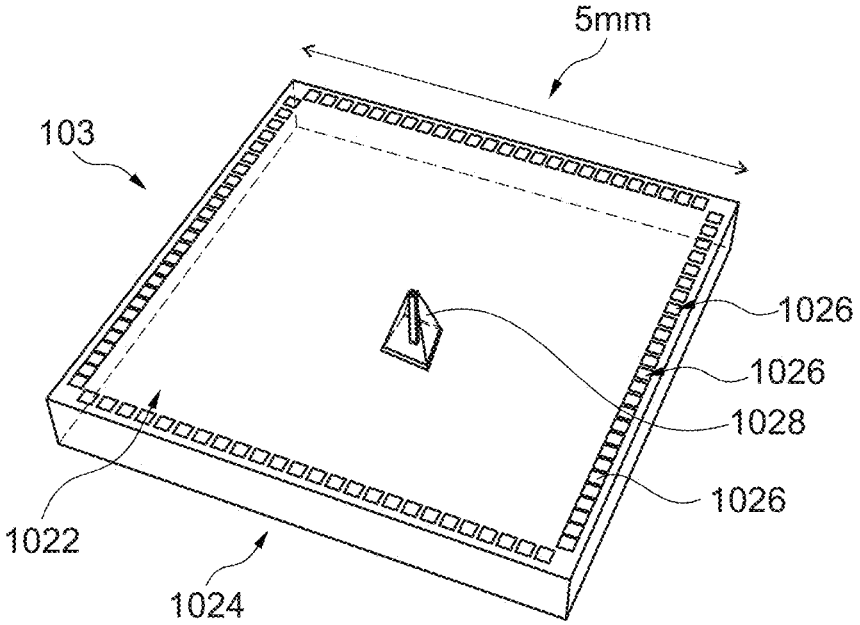
FIG. 3 depicts a NEMS die corresponding to a NEMS device containing one NEMS array in accordance with an embodiment of the present technology.

FIG. 3 depicts an individual NEMS die 103 (corresponding to an individual NEMS device 100) in greater detail. That is, the NEMS die 103 may also be referred to as a NEMS device 100. The depicted NEMS die 103 comprises a front surface 1022 and a back surface 1024, both of which have an area of 5 mm×5 mm. The front surface 1022 comprises electrical contacts 1026, only some of which have been identified by a reference number for simplicity of illustration. The front surface 1022 may comprise 50 to 500 electrical contacts 1026, such as 100 to 300 electrical contacts 1026, e.g., approximately 200 electrical contacts 1026. That is, some embodiments may comprise more electrical contacts 1026 than are shown in FIG. 3, and the electrical contacts 1026 may in fact constitute approximately 30% of the area of the front surface 1022. Furthermore, the NEMS die 103 comprises an opening 1028 extending from the back surface 1024 to the front surface 1022. The opening 1028 may be etched from the back surface 1024, and it may comprise an area of approximately 200 μm×200 μm at the front surface 1022. In this specification, a plurality of exemplary dimensions of different elements will be provided. It should be understood that these exemplary dimensions also give rise to respective ratios and dimensions, which should also be considered to be disclosed by this specification.

Figure 4:
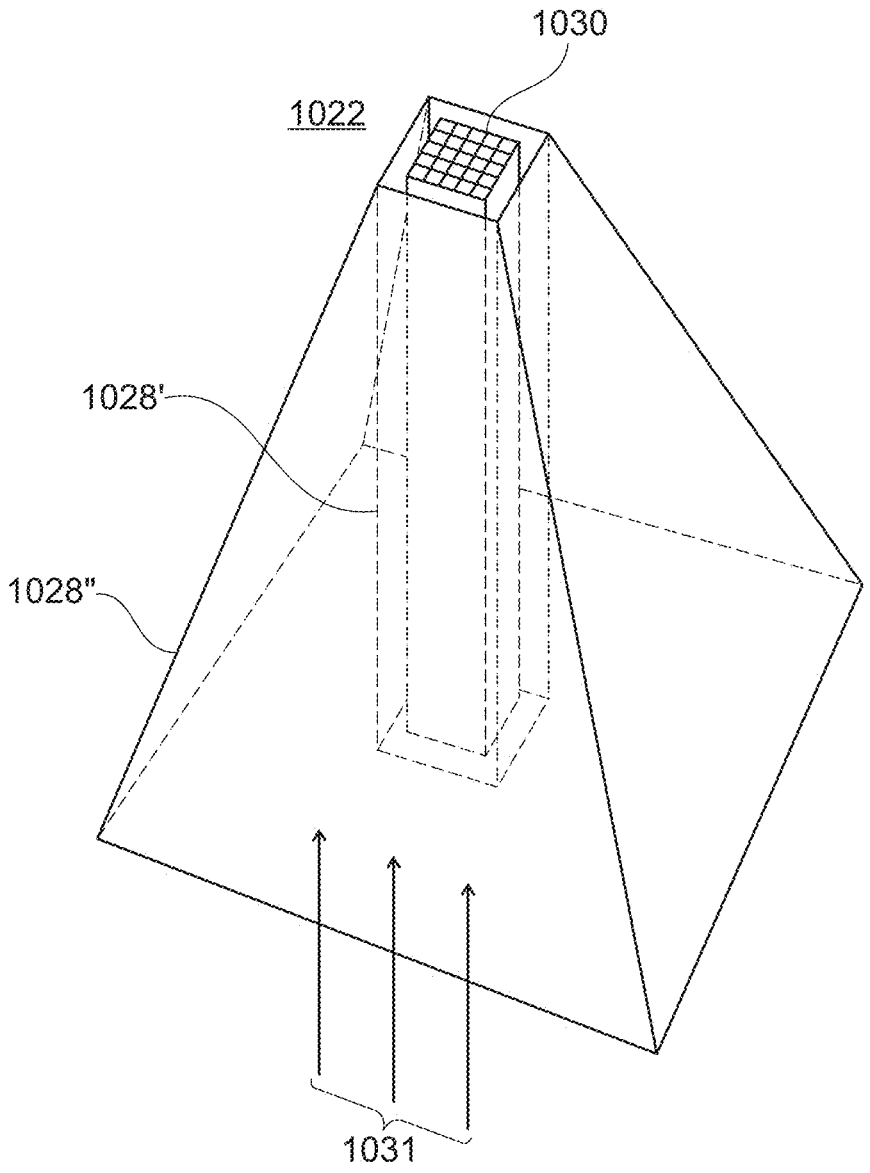
FIG. 4 depicts a NEMS array in accordance with an embodiment of the present technology.

FIG. 4 depicts further details of the opening 1028. The opening 1028 may be etched from the back surface, i.e., arrows 1031 indicate the direction of the backside etch. The etching may be done in a variety of ways, including deep reactive ion etching ("DRIE"), resulting in an approximate etch profile 1028', or potassium hydroxide ("KOH") etching, resulting in an approximate etch profile 1028". At the front surface 1022, a membrane 1030 is formed by through-wafer etching carried out from the back surface.

Figure 5B:
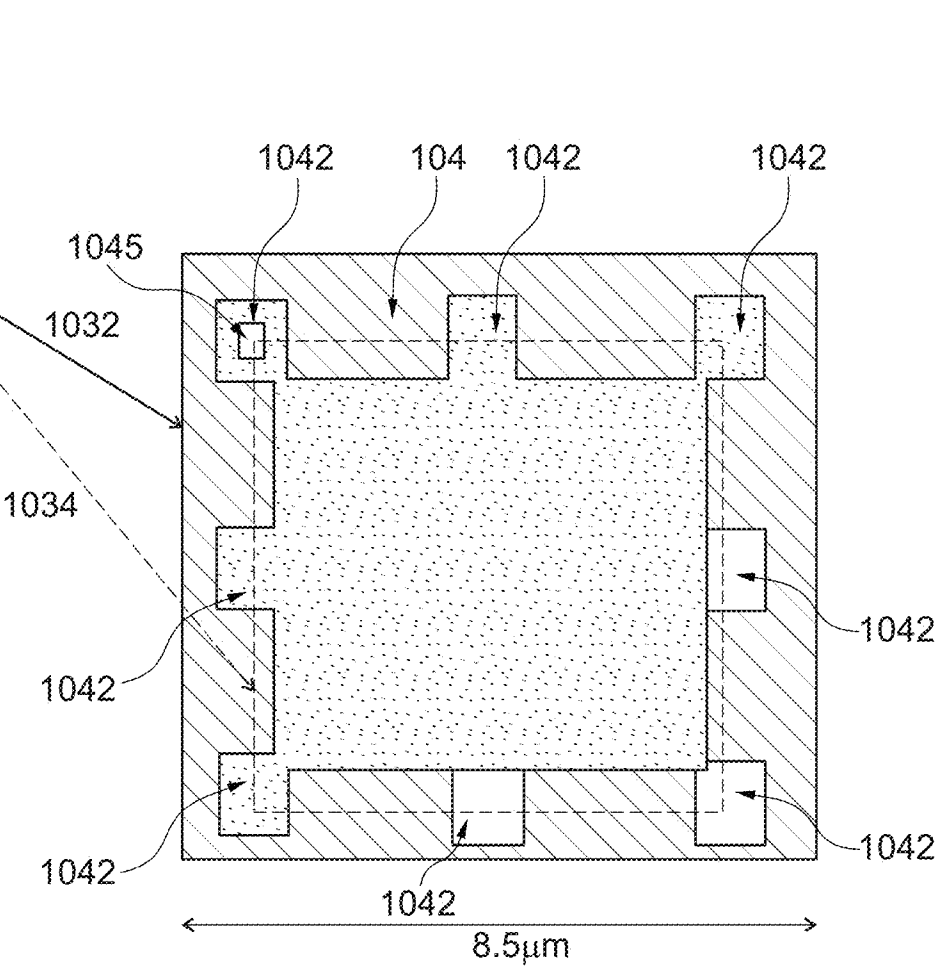
FIG. 5*b* depicts a NEMS sensor in accordance with an embodiment of the present technology.
Figure 5A:
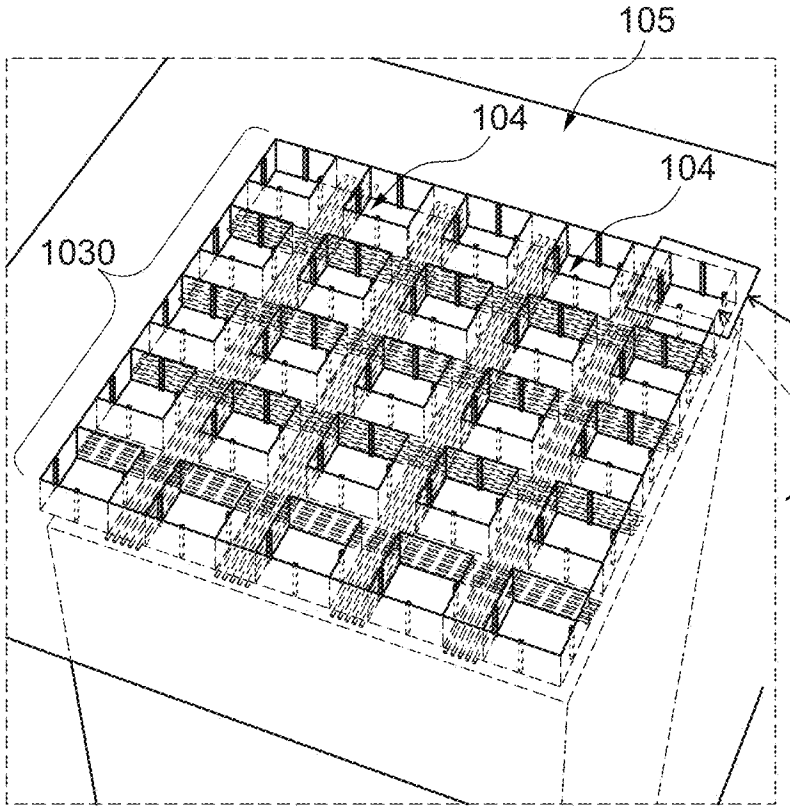
FIG. 5*a* depicts a NEMS array in accordance with an embodiment of the present technology in greater detail.

FIG. 5*a* depicts further details of the membrane 1030. The membrane 1030 accommodates a 5×5 device well, and there are 25 NEMS sensors 104, only two of which are identified in FIG. 5*a* for simplicity of illustration. Each well is an open area where there is no backend oxide nor backend metal for access to the piezoelectric and silicon device layer for lithography of the NEMS sensors 104. Each well has a maximum "height", i.e., an extension perpendicular to the front surface 1022, i.e., an extension along the z-axis (see FIG. 1), up to of 5 μm, such as a height of approximately 2 μm. Reference numeral 1032 indicates a single sensor that takes $1/25^{th}$ of the area of the membrane 1030 and 1034 the outer boundary of the well, which is 8.5 μm. These elements are also included in FIG. 5*b*, which depicts a top view onto a well and onto a NEMS sensor 104. Each NEMS sensor 104 has a plurality of connections 1042 on its periphery, and in the embodiment depicted in FIG. 5*b*, the NEMS sensor 104 comprises 8 such connections 1042, which may be provided with a metal contact 1045. The NEMS sensor 104 may be provided with top and bottom Molybdenum (Mo) electrodes.

Figure 6:
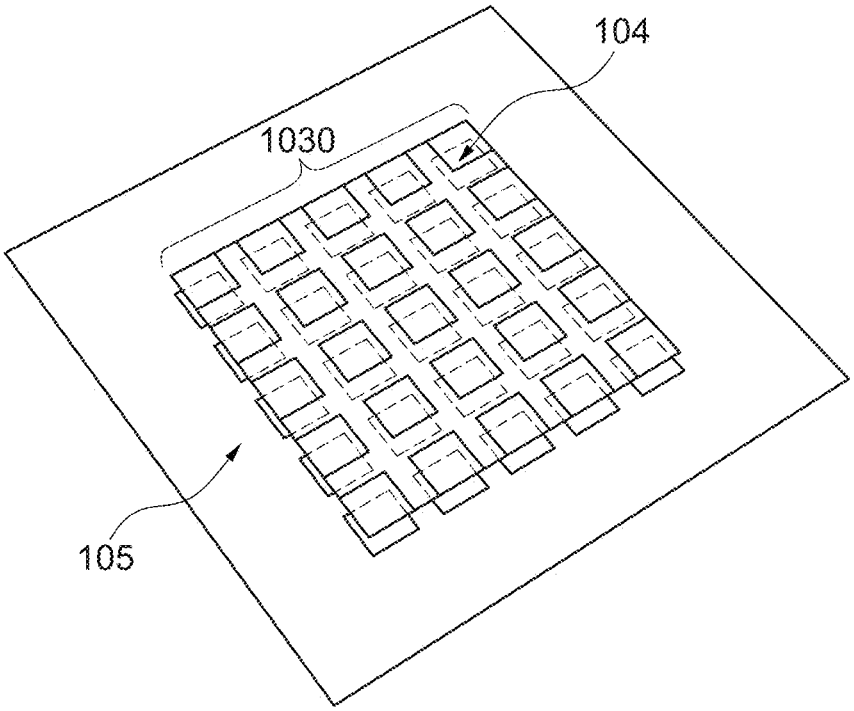
FIGS. 6 and 7 depict still further views of a NEMS array in accordance with an embodiment of the present technology.
Figure 7:
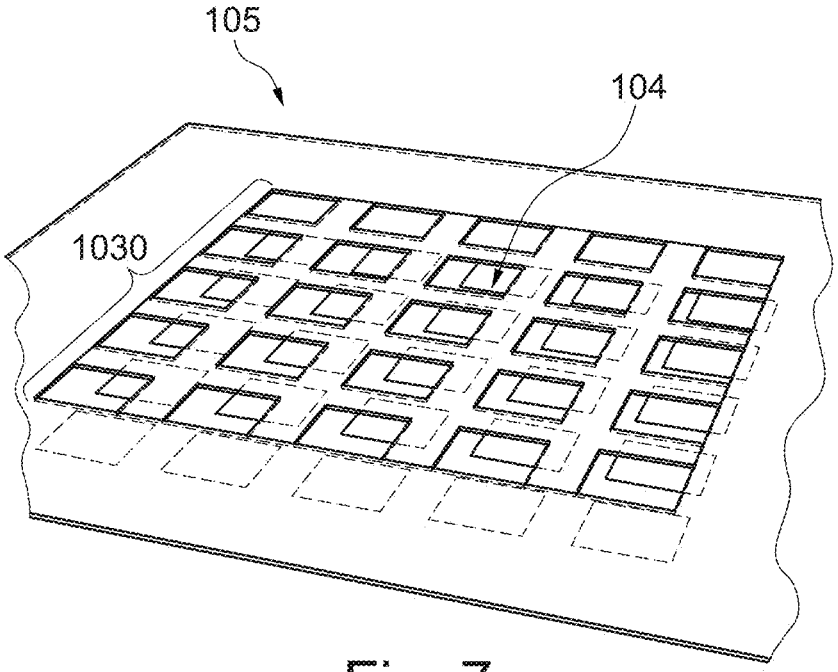

FIGS. 6 and 7 depict further perspective views of the membrane 1030 and the NEMS sensors 104, only one of which is identified with a reference numeral in these Figures. The structure defined by the NEMS sensors 104 depicted in FIGS. 6 and 7 may also generally be referred to as a NEMS array 105.

Figure 8:
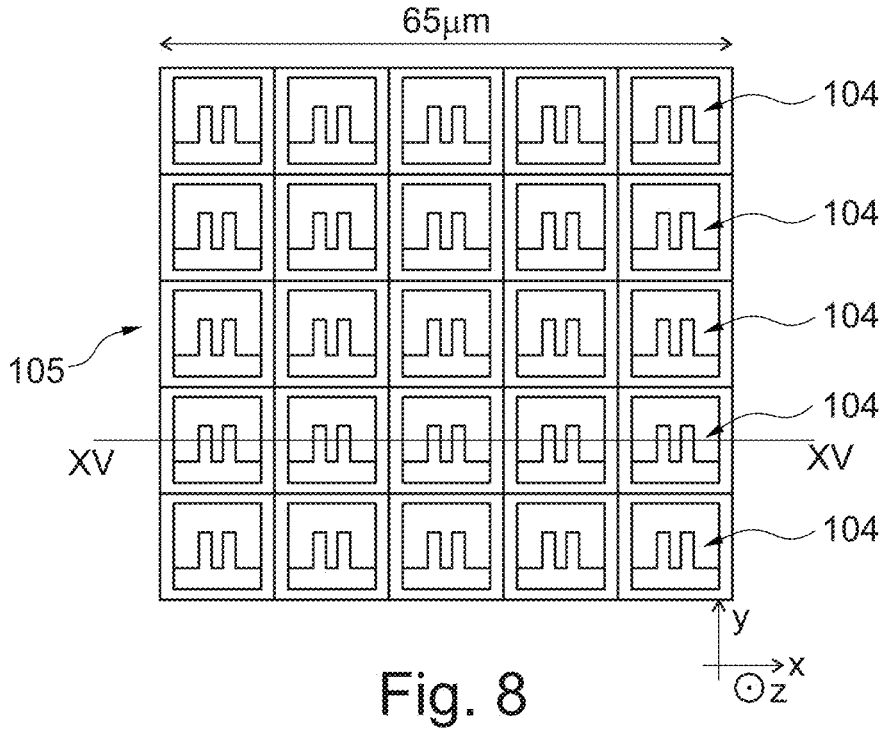
FIG. 8 depicts a still further top view onto a NEMS array in accordance with an embodiment of the present technology.

FIG. 8 depicts another top view onto a plurality of NEMS sensors 104, only some of which are identified with a reference numeral for simplicity of illustration. The plurality of NEMS sensors 104 together constitute the NEMS array 105, which may also be referred to as a NEMS well array 105. The typical area of the NEMS well array 105 may be 65 μm×65 μm.

Figure 9:
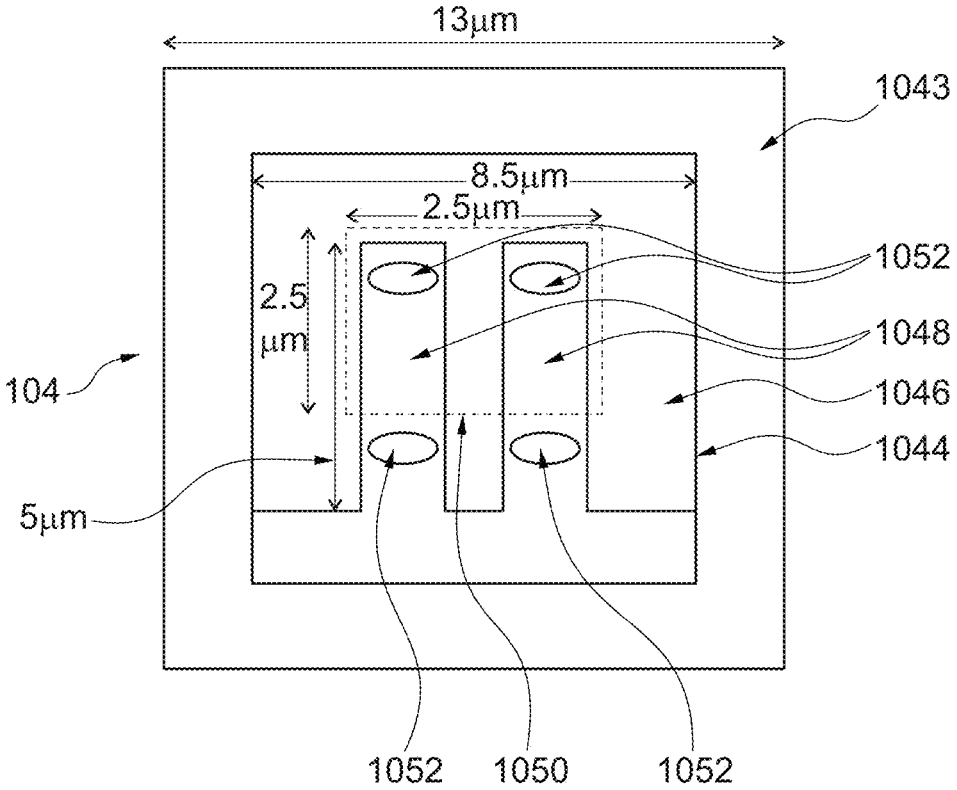
FIG. 9 depicts a view onto a NEMS sensor in accordance with an embodiment of the present technology.
Figure 10:
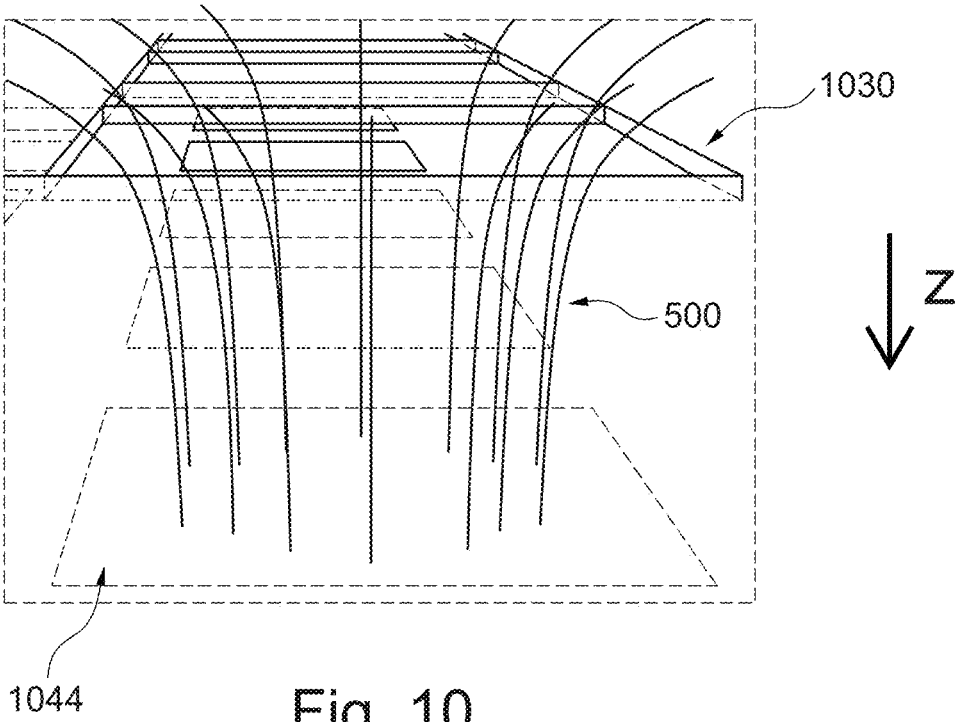
FIG. 10 conceptually illustrates particles that are focused onto a NEMS sensor in accordance with an embodiment of the present technology.

FIG. 9 depicts a further enlarged view onto a single NEMS sensor 104, which may also be referred to as a single device well 104. The NEMS sensor 104 may have an area of approximately 13 μm×13 μm. The NEMS sensor 104 comprises an oxide/metallization section 1043, which may be the circumferential section 1043 of the NEMS sensor 104 and a central NEMS pixel 1044, which may also be referred to as NEMS open area 1044 or NEMS sensor area 1044. It will be understood that the oxide/metallization section 1043 is part of the membrane 1030 (see FIG. 5*a*) and is thus located "in front" of the NEMS pixel 1044, i.e., it has a different position in the z-direction (see FIG. 10). The NEMS pixel 1044 may have an area of approximately 8.5 μm×8.5 μm. The NEMS pixel 1044 comprises a substrate 1046, which may also be referred to as NEMS empty region 1046, and at least one NEMS resonator 1048. In the embodiment depicted in FIG. 9, the NEMS pixel 1044 comprises two NEMS resonators 1048. However, it will be understood that in other embodiments, the NEMS pixel 1044 may also comprise only one NEMS resonator 1048 or also more than two NEMS resonators 1048. The one or more NEMS resonators 1048 may be, e.g., one or more membrane resonators or one or more cantilever resonators.

The NEMS resonator 1048 defines a NEMS effective area 1050, which may be approximately 2.5 μm×2.5 μm (it is noted that FIG. 9 is not to scale in that regard). Furthermore, each NEMS resonator 1048 also comprises at least one detection or landing area 1052, which may also be referred to as preferred detection area 1052, preferably landing area 1052, or sweet spot 1052. The detection area 1052 of a NEMS resonator 1048 may have an area below 1 $(\mu m)^2$, such as below 0.5 $(\mu m)^2$. For proper detection of particles, it is best when they land on the NEMS landing area 1052.

It will be understood that the exact preferred landing area or sweet spot 1052 may typically vary in dependence of the mode of the NEMS that is to be changed by the particle. In that regard, reference can be made to U.S. Pat. No. 8,227,747 B2 and particularly FIGS. 13A and 13B, as well as the description accompanying these Figures (and it is noted that the content of U.S. Pat. No. 8,227,747 B2 is incorporated by reference herein in its entirety). These Figures depict the frequency shift of different modes of the NEMS in dependence of an impact position of a particle. It will thus be understood that the ideal sweet spot 1052 depends on the mode(s) of the NEMS that is/are to be used.

It will be understood that particles that fly towards the NEMS sensor 104 depicted in FIG. 9, will typically fly towards the NEMS sensor 104 in a direction perpendicular to the drawing plane of FIG. 9 (corresponding to the z-direction indicated in FIG. 1).

Further, considering a NEMS die 103 (corresponding to a NEMS sensor 100) in FIG. 3, it will be understood that this NEMS die 103 comprises one NEMS well array 105, which comprises 25 individual NEMS sensors 104.

Each NEMS sensor area 104 has a NEMS detection area 1052 of approximately $10^{-12}$ $m^2$. Thus, the NEMS well array 105 has an NEMS well array effective area of approximately $25\times10^{-12}$ $m^2$. The same applies for an individual NEMS die 103 (or NEMS sensor 100), as there is one NEMS well array 105 per NEMS die 103 (or NEMS sensor 100). Further, the NEMS die 103 (or NEMS device 100) has an overall area of $25\times10^{-6}$ $m^2$.

The ratio between the NEMS well effective area and the NEMS device is $10^{-6}$. It should be understood that other configurations resulting in different ratios are also possible. For example, it is also possible that the NEMS sensors 104 are packed more densely, side by side. The fill ratio will then be limited by the fill ratio of an individual sensor. Each NEMS sensor has area 104 of approximately $25\times10^{-12}$ $m^2$ and a NEMS detection area 1052 of approximately $10^{-12}$ $m^2$. Therefore, the fill ratio may also be 1/25=4%, or, more generally in the range of 0.5% up to 5%, preferably in a range of 1% up to 4.5%.

Further, it has been found that particles (e.g., ions) landing on the oxide/metallization section 1043 may in fact distort the particle current and thus are therefore considered undesirable, while particles (e.g., ions) passing through the substrate 1046 cannot be investigated (and are thus "wasted"), but do not distort the particle current.

Embodiments of the present technology therefore seek to concentrate the particles (e.g., ions) onto the NEMS detection area 1052 in each NEMS well (a NEMS well being defined by an individual NEMS sensor 104 and the associated section of the membrane 1030). This is very conceptually illustrated in FIG. 10, which depicts NEMS pixels 1044, the membrane 1030, and conceptual trajectories 500 of particles (e.g., ions) that are focused onto the NEMS pixel 1044, and, in particular, onto the NEMS detection area 1052 of the NEMS pixel 1044.

Figure 11:
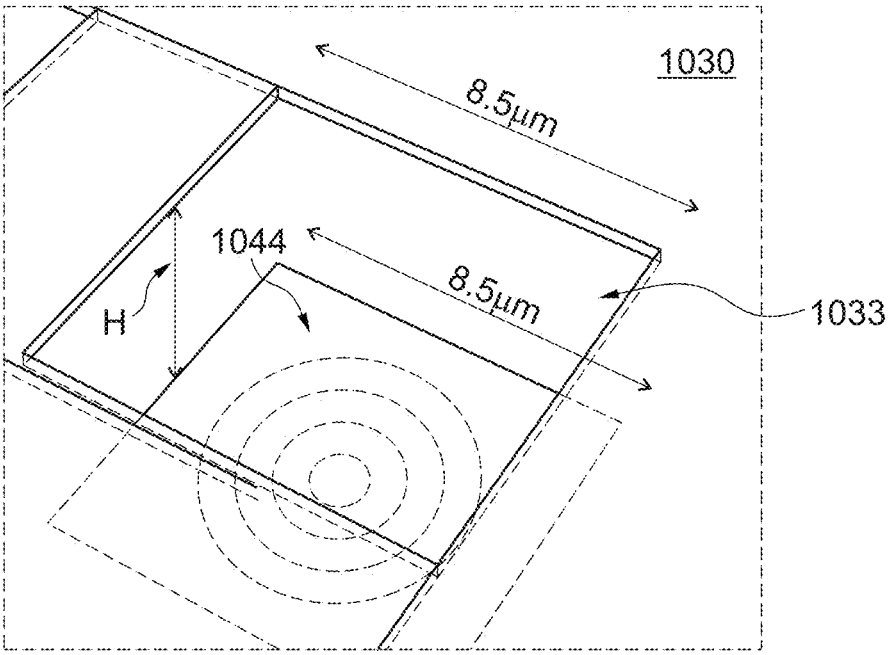
FIG. 11 depicts a still further view of a NEMS sensor in accordance with an embodiment of the present technology.

FIG. 11 depicts a further perspective view onto a NEMS well including the NEMS pixel 1044, and (the associated section of) the membrane 1030. As depicted, the NEMS pixel 1044 may have an area of approximately 8.5 μm×8.5 μm, and the membrane 1030 may have a corresponding opening 1033 with a corresponding size. As already discussed in conjunction with FIG. 5*a*, the well may have a "height" H of up to 5 μm, such as approximately 1 μm to 4 μm, e.g., 2 μm.

Reference is again made to the NEMS device 100 as depicted in FIGS. 1. As explained, the NEMS device 100 corresponds to a single NEMS die 103 depicted in FIG. 3. Such a NEMS die 103 comprises a plurality of individual NEMS sensors 104 (see FIGS. 3 to 5), and each NEMS sensor 104 comprises a NEMS sensor area 1044 (also referred to as NEMS pixel 1044) with a NEMS detection area 1052 (see FIG. 9). As discussed, it may be advantageous to focus the particles to be analyzed onto the NEMS pixel 1044, and preferably also onto the NEMS detection area 1052.

In this regard, it is also noted that the spot of the external ion beam generated by the ion source 2 may have a diameter from many tens to hundreds of micrometers even after focusing by traditional ion optical lenses, which is substantially larger than the dimensions of the NEMS detection area 1052, which is approximately 1 $(\mu m)^2$. That is, the ion beam has to be focused and to be guided towards the NEMS detection area 1052. Following this rationale and assuming the best-case extension of the ion beam of 100 μm×100 μm, it will be understood that only approximately 1 in 10,000 ions would normally land on the NEMS detection area 1052.

Again with reference to FIG. 1, the depicted system 1 may also comprise a micro lens assembly 200, which may be configured for focusing the particle beam.

With particular reference to the embodiment of FIG. 1, it is noted that the system also comprises transfer optics behind the collision cell 16, and that the transfer optics may include a transfer multipole 22, and a Z-lens assembly 24. Again with reference to FIG. 1, (A) shows the position of the interface between NEMS device 100 and the transfer optics 22, 24 where the micro-lenses of the micro lens assembly 200 are included.

Figure 12A:
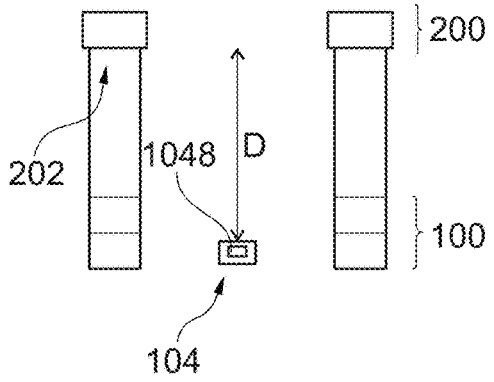
FIGS. 12*a* and 12*b* conceptually illustrate NEMS sensors and micro lenses in cross-sectional views in accordance with embodiments of the present technology.
Figure 12B:
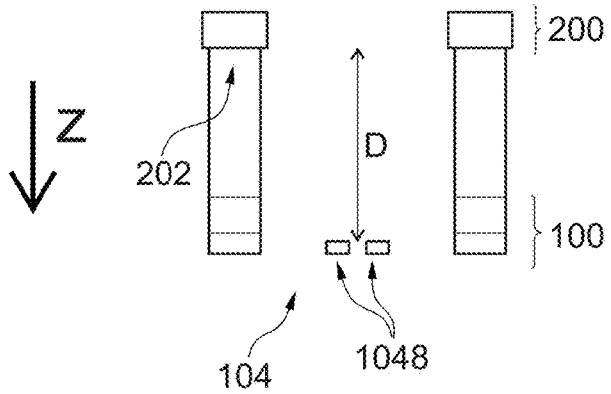

As discussed, the preferred NEMS detection area 1052 typically has a capture area in the range of one square micrometer. To increase the yield of particles, such as ions, captured and analyzed by an individual NEMS pixel 1044 (also referred to as a NEMS sensor pixel 1044) in the NEMS array 100, the present technology directs or focuses the incoming ion flux onto the preferred detection area 1052 of the NEMS device 100. This can be realized by an electrostatic micro-lens assembly 200 positioned in front (preferably directly in front) of each of the NEMS sensor pixels, as is further illustrated in FIGS. 12*a* and 12*b*. FIG. 12*a* schematically illustrates a single NEMS sensor 104 in combination with a micro lens 202 (which may also be referred to as a micro lens combination 202). As discussed, the NEMS device 100 depicted in FIG. 1 comprises a plurality of NEMS sensors 104 as depicted in FIG. 12*a*. As discussed, the NEMS sensor 104 comprises a NEMS pixel with a NEMS resonator 1048, which is also indicated in FIG. 12*a*. It will be understood that there may be provided one micro lens 202 for each NEMS sensor 104. In FIG. 12*a*, the NEMS sensor 104 is depicted to have a single NEMS resonator 1048, while the NEMS sensor 104 in FIG. 12*b* is depicted to have two NEMS resonators 1048. As discussed, focusing of particles could potentially increase their density on the NEMS detection area 1052 by at least 1 or more orders of magnitudes, such as 1 to 2 orders of magnitude.

A separation distance D between the micro lenses 202 and sensor surface of the NEMS sensor 104, i.e., the NEMS sensor area 1044, will be only a few to a few tens of micrometers, dimensions that are typically comparable with both the internal size of the micro-lens elements and the dimensions of the NEMS pixel itself. Thus, precise alignment between the NEMS sensor 104 (and thus, also the complete NEMS device 100) and the micro lens 202 (and thus, also the lens assembly 200) may be advantageous to permit the concentration of ions onto the active "sensing" region on each NEMS pixel 1044—and to avoid landing of ions onto inactive areas of the sensor, especially the dielectric surfaces, e.g., the oxide/metallization section 1043 (which can accumulate charge and cause distortion of the focusing fields).

It will be understood that particles travelling from the micro lens assembly 200 to the NEMS sensor area 1044 may generally collide with gas particles present between the micro lens assembly 200 and the NEMS sensor area 1044, and that this may impact the collection and therefore detection of particles (as the particles may no longer be on their focussed trajectory after such collisions). To reduce such defocusing due to collisions, a reduced pressure may be present between the micro lens assembly 200 and the NEMS sensor 100. The reduced pressure may allow the particles to be analysed to travel relatively freely from the micro lens assembly 200 to the NEMS sensor 100.

More particularly, a reference particle may be defined, the reference particle being representative for the class of particles to be analysed. For example, if it is intended to analyse proteins, a reference protein may be defined. Typically, the reference particle would be an extreme case of the class, i.e., a large particle of the class.

By setting the pressure in the space between the micro lens assembly 200 and the NEMS sensor 104, one can also set a free mean path for the reference particle. It will be understood that the free mean path typically depends on the reference particle, the gas present in the space between the micro lens assembly 200 and the NEMS sensor 104 and the concentration of said gas. More particularly, when reference is herein made to the mean free path, the momentum dissipation mean free path is meant, which can be calculated as $$MFP = \frac{M + m}{m \cdot n \cdot S}$$

where

MFP is the mean free path;

M is the mass of the reference particle;

m is the mass of the gas particle;

n is the concentration of the gas; and

S is the collisional cross section of the reference particle with one particle of the gas.

It will be understood that the collisional cross section is $S=\pi(r_{ref}+r_{gas})^2$, where $r_{ref}$ is the radius of the reference particle and $r_{gas}$ is the radius of the gas particle in the approximation of spherical shape for both particles. As the radius of the reference particle $r_{ref}$ may typically be much greater than the radius of the gas particle $r_{gas}$, the collisional cross section is typically much greater than the cross-section of the gas molecule.

It will be understood that once the reference particle and the gas (which may also be referred to as the background gas) are known, the mean free path mostly depends on the concentration of the gas, and thus its pressure.

Generally, in embodiments of the present technology, the pressure in the space between the micro lens assembly 200 and the NEMS sensor 104 is set so that the mean free path is greater (and preferably substantially greater) than the separation distance D, i.e., the way the particles have to travel from the micro lens 2002 to the NEMS sensor area 1044. This may ensure that the impact location of the particles is not strongly affected by any collisions of the particles with the background gas.

It will further be understood that residual misalignment and irreproducibility of micro lens shape may further require individual fine adjustment of alignment between axis of the lens and desired ion deposition spot. This could be facilitated by splitting the lens into several segments, e.g. 2-4, with adjustable voltages applied across the cross-section of the lens to steer the ion beam.

As the accuracy of mutual positioning of lenses and NEMS sensors within each array may be very high (e.g., better than 1 micron), it may be advantageous to ensure that the lens array and the NEMS array (or NEMS device) are aligned to each other with a similar precision. Such an alignment may be provided by additional piezoelectric or mechanical translational elements, and a calibration procedure may be used to activate these elements and shift lens array relatively to NEMS array in 2 or 3 directions until optimum alignment is reached. For example, the calibration procedure could be tuned to maximize detected ion particles from the "sweet spot" of detection of each NEMS sensor.

Such adjustment also allows flexibility in design: any layout of NEMS sensors could be accommodated, whether 1 or many resonators per sensor, in-center or off-center zones of preferable deposition, etc. Particular settings of steering could be optimized for each microlens individually during the initial calibration process that takes place at the initial installation and then possibly at some intervals as appropriate for a particular application. Further, there may be several NEMS devices served by one micro-lens.

Manufacturing of the micro-lenses 202 could be realized by micro- or nano-systems fabrication technologies, either co-integrated with the NEMS device 100, thus enabling precise alignment of the lens assembly 200 in front of the NEMS device 100, or fabricated as a separate structure and assembled in a controlled post-process step using specially-designed guides to insure proper alignment of the separate components. It may be advantageous for operation of both lens 202 and NEMS device 100 that a mean free path of residual gas around them is larger, and preferably substantially larger than the largest characteristic dimension of either lens 202 or individual NEMS sensor 104, preferably more than $10^4$ to $10^5$ times larger.

Figure 13:
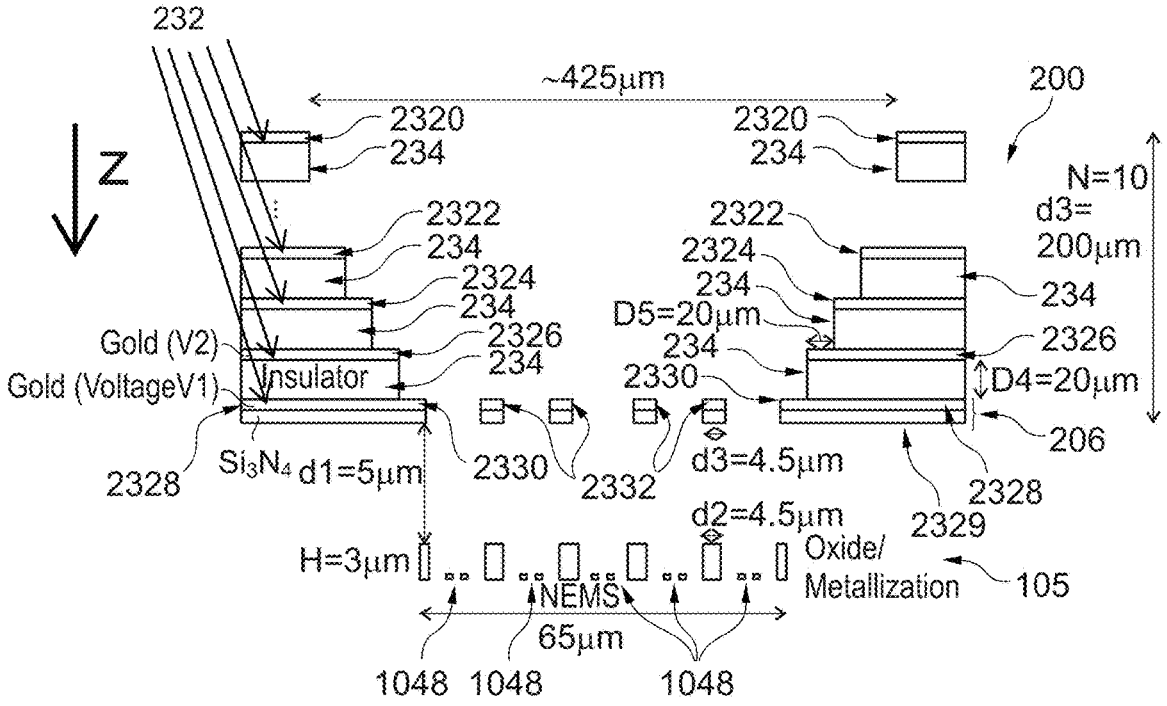
FIG. 13 depicts a cross-sectional view across a NEMS array and a micro lens assembly in accordance with an embodiment of the present technology.

FIG. 13 depicts an exemplary section along the x-z-plane (for definition of the directions, see FIGS. 1 and 8), i.e., along line XV-XV in FIG. 8 intersecting through a NEMS well array 105 and through a micro lens assembly 200, which may also be referred to as a micro lens module. In the depiction of FIG. 13, there are depicted 5 NEMS sensors 104, each comprising at least one NEMS resonator 1048. Further, the well is depicted to have a height H of 3 μm. As also depicted in FIG. 8, the NEMS well array 105 may have a size of 65 μm, and the individual NEMS sensors 104 may be separated by a distance d2 of 4.5 μm. Furthermore, FIG. 13 also depicts the micro lens assembly 200, which is distanced from the NEMS well array 105 by a distance d1 of 5 μm, though this is only exemplary, and other distances, such as 1 μm to 15 μm, preferably 1 μm to 10 μm may be used. It will be understood that the discussed separation distance D from the micro lens assembly 200 to the NEMS sensor area 1044 equals the sum of the distance d1 and the height H.

Figure 14:
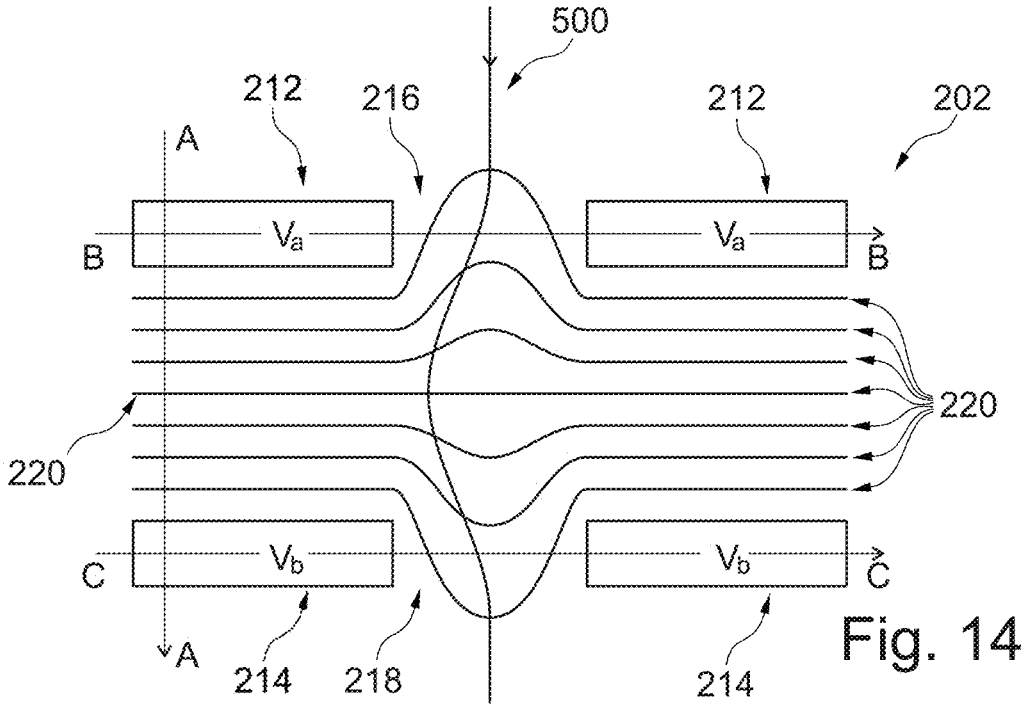
FIG. 14 illustrates principles of an electrostatic micro lens.

FIG. 14 illustrates how a micro lens or ion lens 202 may work. In the depicted embodiments, the ions lens 202 is realized as an electrostatic immersion lens. The ion lens 202 depicted in FIG. 14 comprises two electrodes 212, 214, and each electrode 212, 214 comprises an aperture 216, 218, through which particles, such as ions, may pass. In some examples, the electrodes 212, 214 may be round. In other embodiments, the electrodes may be square-shaped. Electrode 212 is at an electric potential Va, and electrode 214 is at an electric potential of Vb, where Vb>Va (i.e. the lens is decelerating positive charged ions). In FIG. 14, there are also depicted equipotential lines 220.

Figure 14A:
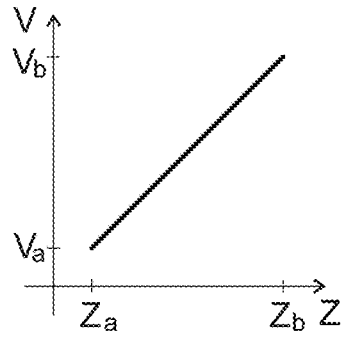
FIGS. 14*a* to 14*c* depict the electric potential along horizontal and vertical lines indicated in FIG. 14.

FIG. 14*a* depicts the electric potential along line A-A in FIG. 14, i.e., the electric potential between the electrodes 212, 214. Here, the potential of the electric field rises (almost) linearly from the potential Va of the first electrode 212 to the potential of the second electrode 214.

Figure 14B:
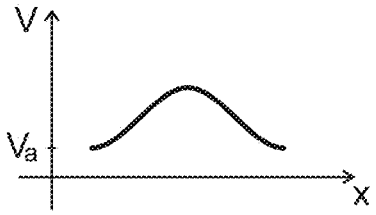

FIG. 14*b* depicts the potential V of the electric field along line B-B in FIG. 14, i.e., in the aperture 216 of the first electrode 212. Again, at the electrode 212, the potential V is the potential Va of the first electrode 212. The closer the location to the center of the aperture 216, the higher the potential V.

Figure 14C:
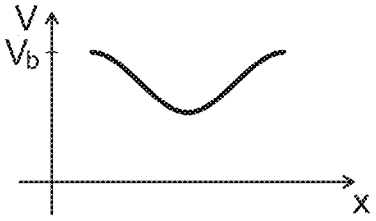

Correspondingly, FIG. 14*c* depicts the potential V of the electric field along line C-C in FIG. 14, e.g., in the aperture 218 of the second electrode. Again, at the electrode 214, the potential V is the potential Vb of the second electrode 214. The closer the location is to the center of the aperture 218, the lower the potential V.

In FIG. 14, there is also depicted an exemplary trajectory 500 of a positively charged particle, i.e., of a positively charged ion. When entering the micro lens 202, the particle is displaced from a central axis of the micro lens 202. Before the particle reaches the longitudinal center of the micro lens 202, which longitudinal center coincides with equipotential line 220', the particle experiences a field along the x-direction which generally corresponds to the field depicted in FIG. 14*b*, i.e., a field having its maximum potential in the center. Thus, the particle is subjected to a force that forces the particle outwardly, and the particle travels outwardly.

Once the particle has surpassed the longitudinal center 220' of the micro lens 202, the electric field along the x-direction generally corresponds to the one depicted in FIG. 14*c*, i.e., the potential is lowest in the center and increases with increasing distance to the center. Again, the particle "seeks" the lower potential and is thus forced towards the center. As ion velocity is lower in this region, the electric field acts for longer and the total effect is strong convergence of ions towards the axis of the micro lens.

Thus, an arrangement as depicted in FIG. 14 can be used to focus charged particles, and this illustrates the general operating principle of electrostatic lenses.

The micro lens assembly or micro lens module 200 in FIG. 13 is more sophisticated, but based on the above principle. The depicted micro lens assembly 200 comprises a plurality of electrodes 2320, 2322, 2324, 2326, 2328, such as 10 electrodes 232. The electrodes 232 may be square-shaped. Each electrode 232 may define an aperture. In the depicted embodiment, the aperture may become successively smaller. E.g., the first or forward electrode 2320 may have an aperture of 425 μm and the size of each aperture may be approximately 40 μm smaller than the size of the preceding aperture. This corresponds to each electrode protruding by D5 of 20 μm on each side with respect to the preceding aperture. That is, the apertures may have successive sizes of 425 μm, 385 μm, 345 μm, 305 μm, 265 μm, 225 μm, 185 μm, 145 μm, 105 μm, 65 μm. Overall, the micro lens assembly 200 may have a length d3 of approximately 200 μm.

The electrodes 232 may be formed of gold, molybedenum, gold-coated aluminum, etc. and/or they may have a thickness of approximately 200 nm. They could be thickened by electroplating.

The electrodes 232 may be separated by insulators 234. The shape of the insulators 234 may correspond to the shape of the electrodes 232. E.g., the electrodes 232 (except for the last or rear electrode 2328) and insulators 234 may form pairs, and the electrode 232 and the respective insulator 234 of one pair may have corresponding shapes, particularly aperture sizes. The insulators 234 may have a thickness D4 of approximately 20 μm. The insulators may be formed of parylene or SU8.

The last or rear electrode 2328 may be followed by a layer 2329 of $Si_3N_4$.

In the embodiment depicted in FIG. 13, the last electrode 2328 may have a shape generally corresponding to the membrane 1030 of the NEMS array 105. That is, the electrode 2328 may have both a circumferential portion 2330 and mesh portions 2332. The mesh portions 2332 may also be referred to as grid portions 2332 or web portions 2332. The $Si_3N_4$ layer 2329 may have corresponding sections. This arrangement including the circumferential portion 2330 and the web portions 2332 and the corresponding $Si_3N_4$ layer 2329 may also be referred to as a micro lens array 206.

It will be understood that the electrodes 232 may be supplied with different voltages, e.g., the last electrode 2328 may be supplied with a last electrode voltage V1, and the second last electrode 2326 may with a second last electrode voltage V2.

As also discussed in connection with FIG. 14, an arrangement of electrodes may thus work as an ion lens. It will be appreciated that the general setup in FIG. 13 is such that the first electrode has a larger aperture than the others and that the apertures then become successively smaller. Thus, charged particles may be successively focussed by this setup.

As discussed, the last electrode 2328 may not only comprise a circumferential portion 2330, but also the web portions 2332, such that the apertures of the last electrode correspond to the apertures in the membrane 1030 of the NEMS array 105. Thus, the setup depicted in FIG. 13 may be used to focus or guide particles onto the individual NEMS resonators 1048.

The micro lenses and micro lens assemblies 200 may have different ion optical shapes as is further shown in FIG. 15.

Throughout FIGS. 15*a* to 15*d*, the NEMS well array 105 corresponds to the one depicted in FIG. 13, i.e., the NEMS sensors with the NEMS resonators 1048 are arranged into a regularly spaced array, and a correspondingly patterned compound micro-lens assembly or module 200*a*, 200*b*, 200*c*, 200*d* may be employed.

The micro-lens assembly 200*a* in FIG. 15*a* comprises a micro lens array 206 comprising an electrode 2328 and a $Si_3N_4$ layer 2329, wherein the electrode 2328 comprises a circumferential portion 2330 and web portions 2332, and wherein the $Si_3N_4$ layer 2329 comprises corresponding portions. The micro lens array 206 may comprise the features discussed above in conjunction with FIG. 13. Further, the micro lens assembly 200 may comprise a tapering electrode 2327. The tapering electrode 2327 may taper along the z-direction. The tapering electrode 2327 may have an overall ring shape, such that the tapering generates an overall conus shape, or the tapering electrode 2327 may have an overall square shape, such that the tapering generates an overall frustrum shape. A tapering angle of the tapering electrode 2327 may be approximately 45°. Again, the tapering electrode 2327 may be formed of gold, and the tapering electrode 2327 may be at an electric potential V2 different from the electric potential V1 of the electrode 2328. The electrode 2328 and the tapering electrode 2327 may be separated by an insulator 234, which may be formed of parylene or SUB. The micro-lens assembly 200*a* may have an overall length l of approximately 200 μm along the z-direction.

In other words, the embodiment depicted in FIG. 15*a* may employ a micro lens array 206 and a "first lens", i.e., electrode 2327, above the whole array 206. The electrode 2327 focuses the ion beam onto the lens array 206. Subsequently, each discrete micro-lens 2060 (defined by the apertures of the micro lens array 206) above each NEMS pixel would then focus the shaped ion beam into separate beamlets delivered to the active area of each NEMS pixel. This combination could increase the ion capture efficiency by the NEMS sensor array from under 1% to above 50%.

This allows to locate ions into areas 1048 of NEMS sensor that are especially favourable for multi-physics measurements (e.g. shape and size in addition to mass) using multiple harmonics of sensor oscillations as described in WO2016/118821A1.

The embodiment depicted in FIG. 15*b* mostly correspond to the one depicted in FIG. 13, and thus reference can be made to the above description of FIG. 13 for most of the features depicted in FIG. 15*b*. However, in addition to the features discussed above in conjunction with FIG. 13, the embodiment of the micro lens assembly 200*b* in FIG. 15*b* comprises a Si support 240. The Si support 240 is located rearward of the last electrode 2328 and of the $Si_3N_4$ layer 2329.

In this regard, it is noted that rearward and forward as used herein denote orders of elements along the z-direction.

With general reference to FIG. 1, it is noted that the particles travel from a forward to a rearward direction. That is, the particle source 2 is the most forward element and, e.g., the lens assembly 200 is more forward than the NEMS device 100. Rearward or rear denotes the opposite of forward.

The Si-support 240 may have a length d6 of approximately 100 μm along the z-direction. Further, the Si-support 240 may taper towards the electrode 2328 and the $Si_3N_4$ layer 2329, i.e., it may have an aperture increasing with increasing distance from the electrode 2328 and the SiN $Si_3N_4$ layer 2329. The provision of the Si support 240 may simplify the construction of the system 1.

FIG. 15*c* depicts a still further embodiment of a micro lens assembly 200*c*. The depicted micro-lens assembly 200*c* comprises a plurality of electrodes 2322, 2324, 2326, 2328, and a plurality of insulators 234 located between the electrodes 2322, 2324, 2326, 2328. The insulators may have a length D4 generally of the same order of magnitude as the opening of the micro-lens. Further, the micro lens assembly 200*c* may also comprise a $Si_3N_4$ layer 2329 rearward of the last electrode 2328. The electrodes 2322, 2324, 2326, 2328 may be supplied with different voltages V1, V2, V3, and V4. All of the discussed elements, i.e., the electrodes 2322, 2324, 2326, 2328, the insulators 234, and the $Si_3N_4$ layer 2329 comprise respective circumferential portions 2330, 2342, 2331 and respective web portions 2332, 2344, 2333, only some of which are identified in FIG. 15*c* for simplicity of illustration. The circumferential portions 2330, 2342, 2331 and the web portions 2332, 2344, 2333 may thus define apertures, each corresponding to an individual NEMS well of the NEMS well array. Thus, each aperture may act as an individual lens for focusing particles onto the respective NEMS sensor 104. As depicted, the electrodes 2322, 2324, 2326, 2328, the insulators 234 and the $Si_3N_4$ layer may have the same shape and size in the x-y-plane.

FIG. 15*d* depicts a still further embodiment of a micro lens assembly 200*d*. The micro lens assembly 200*d* comprises a rear electrode 2328 comprising a peripheral portion 2330 and web portions 2332 as in the previous embodiments. Further, rearward to the rear electrode 2328, the micro lens assembly 200*d* also comprises a $Si_3N_4$ layer 2329 with a peripheral portion and web portions as discussed in connection with the previous embodiments. The micro lens assembly 200*d* also comprises a forward electrode 2335 located more forward than the rear electrode 2328. Overall, the forward electrode 2355 may have a length d7 along the z-direction of approximately 3 μm. The forward electrode 2355 comprises a peripheral portion 2357 and mesh portions 2359. The mesh portions 2359 may also be referred to as grid portions 2359 or web portions 2359. The peripheral portion 2357 tapers in the front to rear direction, e.g., at an angle of approximately 45°. In other words, the peripheral portion 2357 is disposed at an angle of approximately 45° with regard to the z-axis.

Further, in the cross-sectional view of FIG. 15*d*, the web portions 2359 are also provided at an angle, e.g., of approximately 45° with respect to the z-axis. That is, in the cross-sectional view of FIG. 15*d*, the web portion 2359 may have a general V-shape. Between the forward electrode 2355 and the rear electrode 2328, the micro lens assembly 200*d* also comprises an insulator 234, which also comprises a peripheral portion 2342 and web portions 2344. The insulator 234 may have a thickness of approximately 0.25 μm.

Again, the rear electrode 2328 may be at a first voltage or electric potential V1 and the forward electrode 2355 may be at a second voltage or electric potential V2, different from the first electric potential V1. The peripheral portions and the web portions (of the forward electrode 2335, the rear electrode 2328, the $Si_3N_4$ layer 2329, and the insulator 234) again define apertures acting as individual lenses for particles, such as ions. Due to the tapering of the peripheral portion 2357 of the forward electrode 2355 and the V-shape of the web portions 2359 of the forward electrode, the individual apertures ("the lenses") may also be referred to as conical lenses. Again, this design may be used to focus particles, such as ions onto the individual NEMS sensors 104, and more particularly onto the NEMS detection area 1052 of the individual NEMS sensors 104.

That is, generally, the present technology allows focusing of the ion beam onto the NEMS sensor 104 at the end of a transfer line with a beam cross-sectional profile that is optimized to the size of the "receiving" sensor array.

Figure 16A:
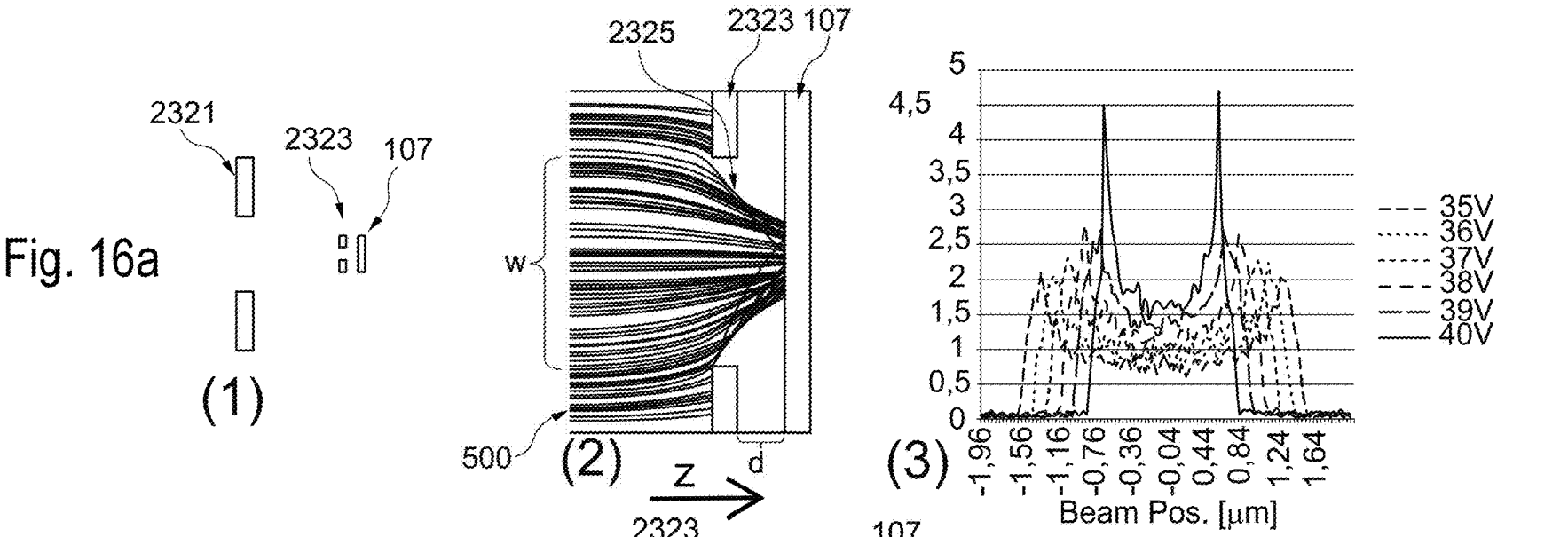
FIGS. 16*a* and 16*b* depict simulations relating to the effect of a micro lens.
Figure 16B:
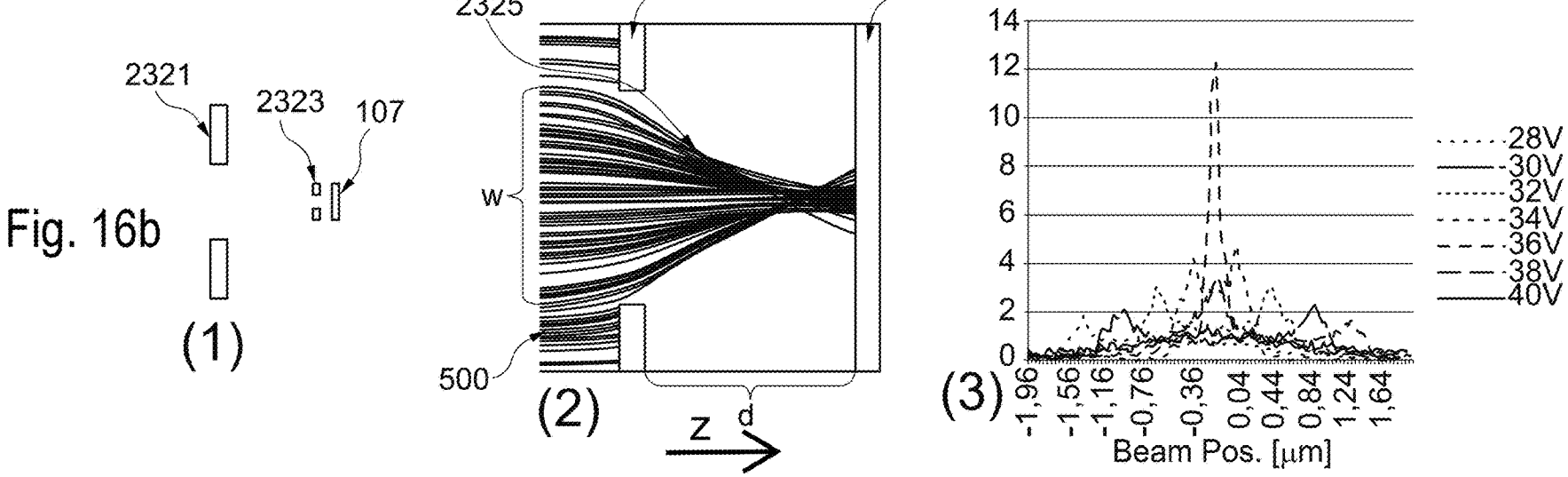

FIGS. 16*a* and 16*b* depict results of simulations used to simulate the effect of an ion lens. More particularly, FIG. 16*a* (1) depicts a general setup of a system used for simulation. The system comprises a first or forward electrode 2321, which may also be referred to as a diaphragm, a second or rear electrode 2323, and a capturing surface 107, which may also be referred to as a membrane. The second or rear electrode 2323 generally corresponds to the electrodes of the micro lens assembly 200 discussed in connection with the above discussed embodiments. As the micro lens assembly 200 discussed above forms an array or a grid, the second or rear electrode 2323 may also be considered to correspond to such an array or grid. The capturing surface 107 corresponds to the plane of the NEMS sensors 104, and more particularly to the plane of the NEMS sensor area 1044. In the simulations, the forward electrode 2321 is at an electric potential of 30 V, the rear electrode 2323 is at an electric potential in the range of 35 V (or 28 V) and 40 V, and the capture surface 107 is at an electric potential of 0 V. FIG. 16*a* (2) depicts the second electrode 2323 and the capturing surface 107 in greater detail. For the simulations performed, the distance d (corresponding to the separation distance D) between the second electrode 2323 and the capturing surface 107 was set to be 2.0 μm. As depicted, the rear electrode 2323 comprises an aperture 2325 with a width w of 8.5 μm. FIG. 16*a* (2) also depicts trajectories 500 of charged particles. For the simulations, the charged particles were assumed to approach as a parallel beam with a kinetic energy of 10 eV±1 eV, wherein ±1 eV relates to the root mean square value of the deviation from the average of 10 eV. It will be understood that in real applications, the spatial and energy spreads of the ion beam will depend on the mass to charge ratio (i.e., m/z) of the ions, due to spreads in the elements "before" (i.e., upstream) of the ion lens. Generally, energy should be lower than the onset of surface-induced dissociation that generally lies at around a ion velocity of 5,000 to 10,000 m/s or 10 to 30 eV per charge.

FIG. 16*a* (3) depicts the distribution of the beam intensity (in arbitrary units) vs. the position on the capturing surface 107 for different voltages of the rear electrode 2323. The voltages, i.e., the electric potentials of the rear electrode 2323 were set to be between 35 V and 40 V. As can be seen in FIG. 16*a* (3), generally, the higher the voltage (in the range between 35 V and 40 V), the more focussed the beam becomes. Already at a voltage of 35 V, the beam is mostly focussed at locations between −1.6 μm and +1.6 μm, i.e., in a range of 3.2 μm. For a voltage of 40 V, the beam is focused to less than 2 μm. With reference again to FIG. 9, it is noted that the preferred NEMS detection area 1052 typically is around 1 $(\mu m)^2$. Thus, the arrangement simulated in FIG. 16*a* cannot be considered optimal for focusing the charged particles onto the preferred NEMS detection area 1052 as the lens is located too close to the NEMS sensor.

FIG. 16*b* depicts the results of a second simulation having a setup generally corresponding to the one discussed in connection with FIG. 16*a* but at a larger distance that corresponds to a preferred embodiment. As regards FIG. 16*b* (1), its setup generally corresponds to the one discussed in connection with FIG. 16*a* (1), one difference being that the rear electrode 2323 was set to voltages between 28 V and 40 V. FIG. 16*b* (2) again depicts the setup in more detail, the difference with respect to FIG. 16*a* (2) being that the rear electrode 2323 is distanced by a greater distance d of 8.5 μm from the capturing surface 107. Again, a parallel incident beam with a kinetic energy of 10 eV±1 eV is used for the simulation, the voltage of the forward electrode 2321 was set to be 30 V, the voltage of the capturing surface 107 was set to be 0 V and the voltage of the rear electrode 2323 having an aperture 2325 with a width w of 8.5 μm was varied. FIG. 16*b* (3) again depicts the beam intensity (in arbitrary units) vs. the position on the capturing surface 107 for different voltages of the rear electrode 2323. For voltages between 28 V and 40 V, again, the higher the voltage, the more focused the beam becomes, E.g., fora voltage of 40 V, the majority of the beam's intensity is in a range of −0.2 μm to 0.2 μm, i.e., within a range of 0.4 μm. When again comparing this to the approximate size of the preferred NEMS detection area 1052 (see FIG. 9), which is approximately 1 $(\mu m)^2$, it will be understood that the described technology may indeed facilitate focusing the beam onto the preferred NEMS detection area 1052.

That is, with reference to FIG. 1 again, the depicted embodiment of the present technology relates to a system 1 that may be used to analyse particles, such as ions. The system comprises an ions source 2 for generating a stream of charged particles. Further, the system comprises a vacuum interface 30. After travelling through the vacuum interface 30, the particles are at a pressure substantially below atmospheric pressure.

For analysing the particles, the system 1 further comprises a NEMS device 100 comprising a NEMS array 105 of NEMS sensors 104 (see, e.g., FIG. 5*a*), and each NEMS sensor 104 comprises a NEMS pixel 1044 with an NEMS effective area 1050 and at least one preferred NEMS detection area 1052 (see FIG. 9).

Further, the system 1 also comprises a micro lens assembly 200 for focusing the particles (e.g., ions) onto the NEMS pixels 1044, particularly onto the preferred NEMS detection areas 1052. The micro lens assembly 200 forms a plurality of micro lenses, and generally one micro lens per NEMS sensor 104. Thus, the micro lens assembly 200 may focus the particles onto the individual NEMS pixels 1044, and thus, the system 1 may be more effectively used to analyse particles by means of a NEMS device 100.

More particularly, in embodiments where an individual NEMS pixel 1044 comprises a plurality of NEMS resonators 1048 (e.g., two NEMS resonators 1048 as depicted in FIG. 9), the micro lens assembly 200 may be configured to selectively focus the ions onto the preferred NEMS detection area(s) 1052 of each of the NEMS resonators 1048. This may be done be adjusting voltages (such as left and right voltages) of a micro lens corresponding to the respective NEMS pixel 1044.

In the above, it has been described that a micro lens assembly 200 comprising a plurality of micro lenses 202 can be used to focus particles (such as ions) onto the preferred NEMS detection areas 1052. This may allow a far more sensitive detection of particles.

In some embodiments, the present technology may also be used to desorb (charged) molecules from the NEMS sensor, which may also be referred to as a NEMS sensor 104. The molecules may undergo "soft landing" upon a NEMS resonator 1048, may be desorbed and transported back into the MS instrument 20 for subsequent analysis by the MS instrument 20, including dissociative analysis protocols. Here, "soft landing" means adsorption onto the NEMS pixel 1044 where important attributes of the incoming analyte are preserved; such attributes may include the analyte's charge state, its primary molecular structure (i.e. by adsorption of the intact species, avoiding its fragmentation), and its higher-order structure (i.e., by avoiding denaturing of the protein upon adsorption.) To achieve this, the lens assembly 200 may switch between different potentials to provide electrostatic focusing and analyte deceleration upon deposition (to mitigate the effects of impact upon adsorption) versus optimal acceleration and focusing towards mass spectrometer following desorption experiments.

As regards the basic rationale for deceleration of ions, reference can be made to FIG. 14 that has already been discussed above. As depicted in FIG. 14*a*, there may be an increase of the potential along the z-axis, i.e., along the general direction of travel of the ions. If the potential increases, ions travelling through such a potential will be decelerated. By aptly controlling the potential, one may be able to arrive at a soft landing of the ions onto the NEMS sensor.

Further, after a particle has been deposited on the NEMS sensor 104, the lens assembly 200 may also be used to generate an electric field to desorb the particle from the NEMS sensor 104. It will be understood that there may generally be a force that needs to be overcome in order to separate a particle from the NEMS sensor 104, i.e., to "desorb" a particle from the NEMS sensor 104, and that this force may be provided by an electric potential gradient generated by the micro lens assembly 200. Further rationales of this will be provided below.

Figure 17:
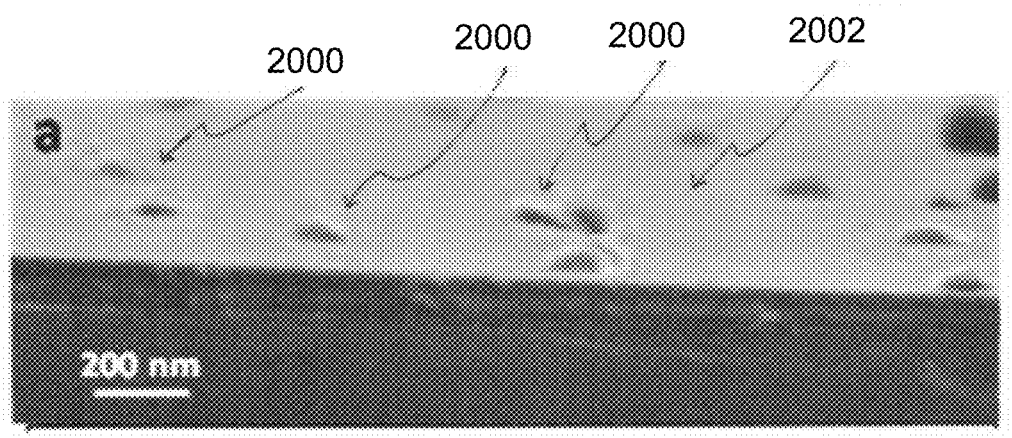
FIG. 17 depicts a photograph of particles deposited on a surface.
Figure 18:
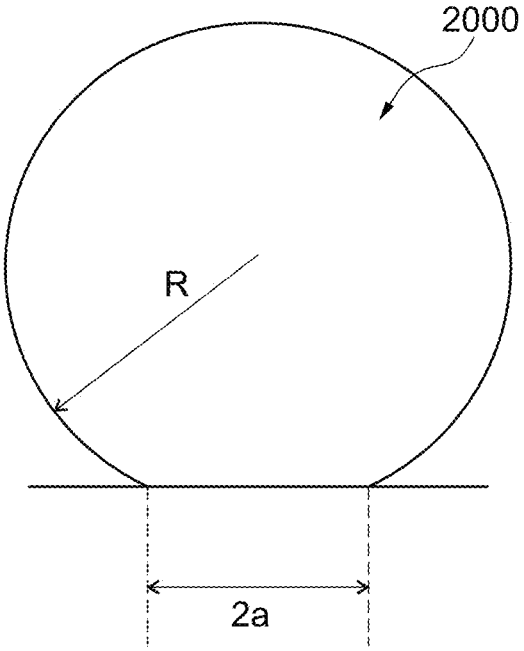
FIG. 18 depicts schematically the flattened contact surface of a particle deposited on a surface.

FIG. 17 depicts an image of particles 2000 (such as ions) deposited on a surface 2002 (such as a surface of a NEMS sensor 104). In such a scenario, there is typically an adhesion force between the particles 2000 and the surface 2002 that cause the particles, which may have a generally spherical shape to flatten. This is also schematically depicted in FIG. 18, depicting a spherical particle 2000 with radius R and a flattened contact surface with diameter 2*a*.

If wanting to remove a particle 2000 that is deposited on a surface 2002, one needs to overcome the adhesion force $F_{ad}$ between these two. Applying the Johnson-Kendall-Roberts (JKR) model of the contact between the particle 2000 and the surface 2002, the adhesion force $F_{ad}$ can be calculated as follows:

$$\begin{aligned} F_{ad} &= 3\pi R\gamma_s \\ &\approx 3\pi(15\ \text{nm})\cdot(5-150\ \text{mN/m}) \\ &= 0.7-21\ \text{nN} \end{aligned}$$

See, Israelachvili, J. N. Intermolecular and surface forces: revised third edition (2011), and herein equation (12.10), where R is the radius of the particle and $\gamma_s$ is the energy per unit area. It is noted that equation (12.10) in this book relates to two spheres, but the above equation can be derived from equation (12.10) in this book when considering the flat surface to be a sphere with an infinite radius. The particle size is assumed to be approximately 15 nm and $\gamma_s$ is assumed to be between 5 to 150 mN/m. The latter assumption is based on assuming that the interaction between the surface and the particles is dominated by van-der-Waals forces (see the above book and Ruz Tamayo Pini et al. Physics of Nano-mechanical Spectrometry of Viruses. Sci Reports 2014, in that regard). Thus, the force required to absorb a particle from a NEMS sensor 104 can be estimated to be between 0.7 and 21 nN.

The mechanical force from routine NEMS operation can be expressed as follows:

$$F_{mech} = m \cdot a = m \cdot \frac{d^2 s}{dt^2}$$

$$F_{mech} = m a_0 \omega^2 \sin(\omega t)$$

$$F_{mech,max} \approx (800\ \text{kDa}) \cdot (50\ \text{nm}) \cdot (2\pi \cdot 20\ \text{MHz})^2 = 0.001\ \text{nN}$$

Herein, the following notation was used:

m: mass of the particle;

a: acceleration;

s: location;

$a_0$: amplitude of the oscillation; and

ω: oscillation frequency.

For the estimation, typical values for these parameters were used.

An electric field needed for removing particles (of a charge z=70) from the surface can thus be estimated as follows:

$$E_{desorb} = F_{ad} / q$$

$$\approx (.7 - 21\ \text{nN}) / (70\ e)$$

$$= 60 - 1870\ \text{V/}\mu\text{m}$$

A very strong electric field generated by a micro lens 202 is determined by simulating such fields, as was done in FIGS. 19*a* to 20*c*, each depicting results of simulations referring to configurations which generally correspond to micro lenses 202. The simulations were generated by using the simulation software SIMION®.

Figure 19A:
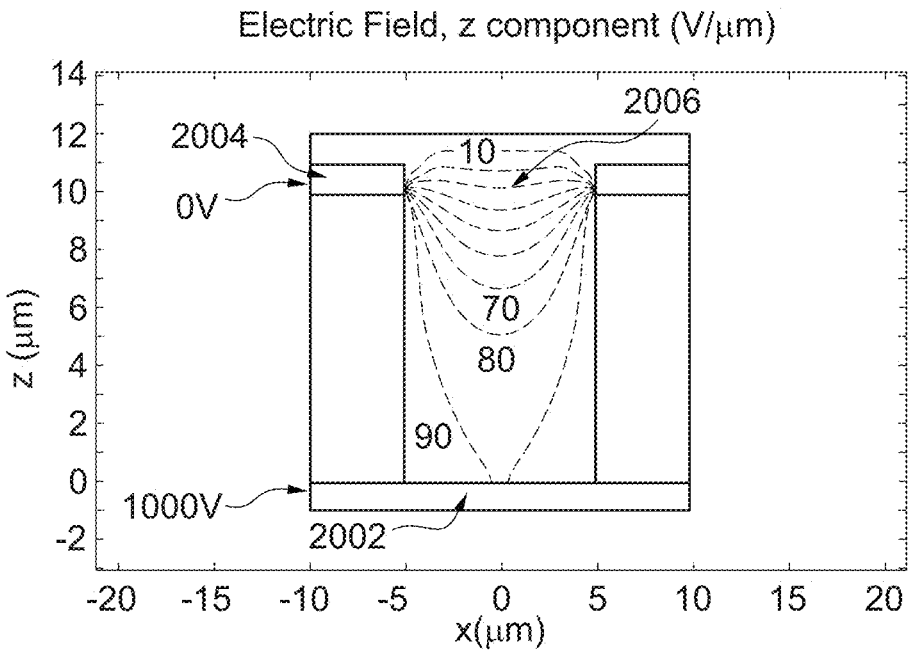
FIGS. 19*a* to 19*d* depict simulations relating to the electric field generated by a micro lens.

More particularly, FIG. 19*a* is the result of a simulation having a surface 2002 at an electric potential of 1000 V and having a portion 2004 at an electric potential of 0 V. The portion 2004 comprises an opening 2006, which is surrounded by material on four sides. The opening 2006 is square shaped with a size of 10 μm×10 μm. The portion 2004 is distanced from the surface 2002 by a distance, which is 10 μm in FIG. 19*a*. Between portion 2004 and surface 2002, there is located an insulator separating the portion 2004 from the surface 2002. It will be understood that the configuration depicted in FIG. 19*a* generally corresponds to a combination of a micro lens 202 and a NEMS sensor 104, the surface 2002 corresponding to the NEMS sensor 104 (and more particularly to the NEMS sensor area 1044) and the portion 2004 with the opening 2006 corresponding to the micro lens 202. FIG. 19*a* depicts the resulting electric field in the z-direction for the simulation based on the configuration depicted in FIG. 19*a*. FIG. 19*a*, also includes lines of constant electric field relating to an electric field of 10 V/μm (the most upmost line) to 90 V/μm (the line touching the surface 2002), with the other lines of constant field representing multiples of 10 V/μm. As can be seen, in the vicinity of the surface 2002 (corresponding to the NEMS sensor 104), the electric field has a z-component of approximately 90 V/μm and higher.

Figure 19B:
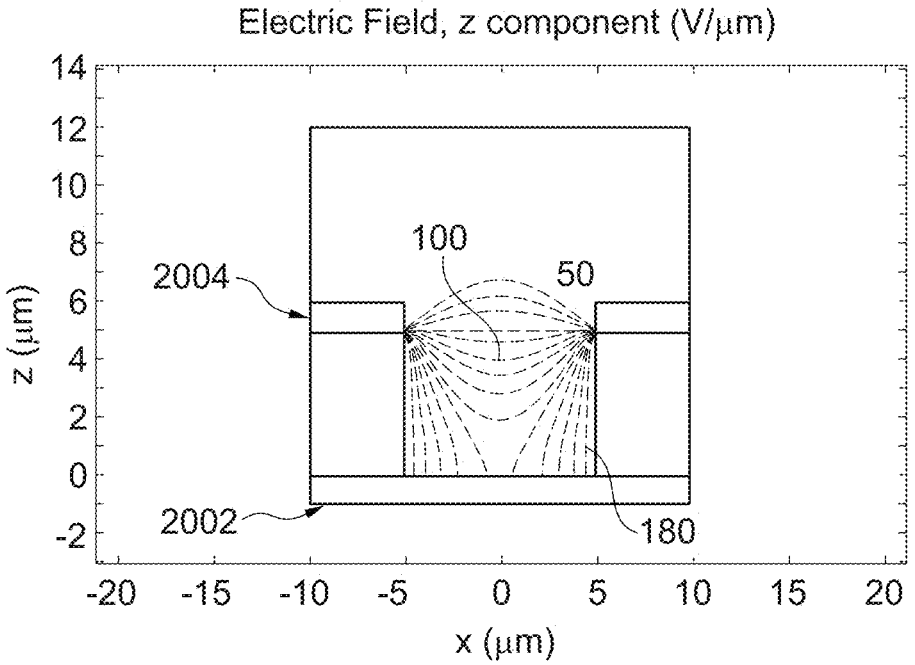
Figure 19C:
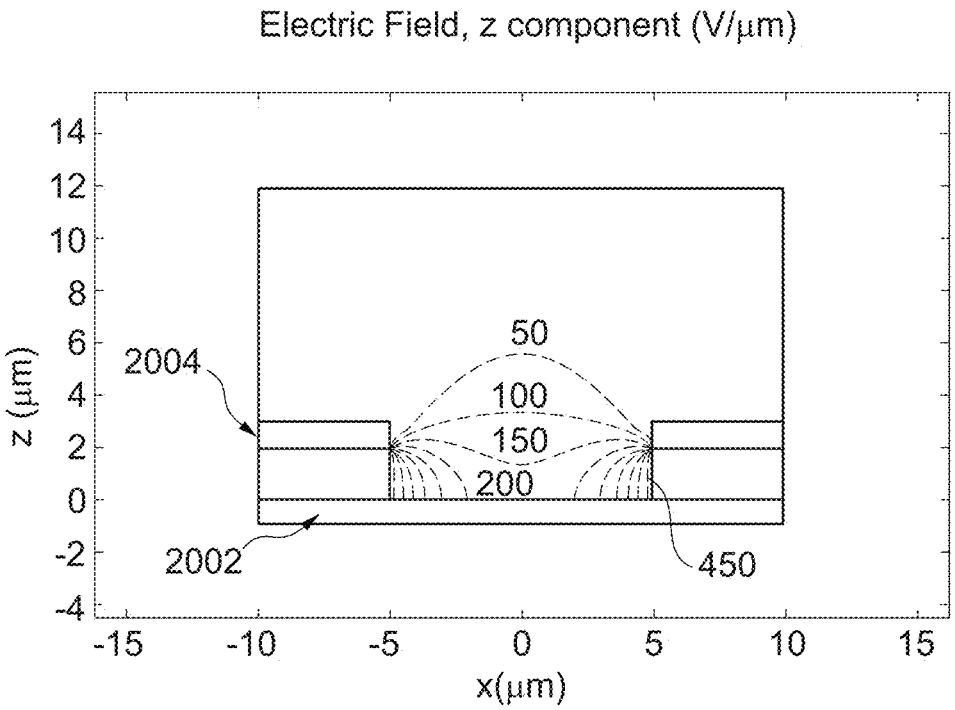
Figure 19D:
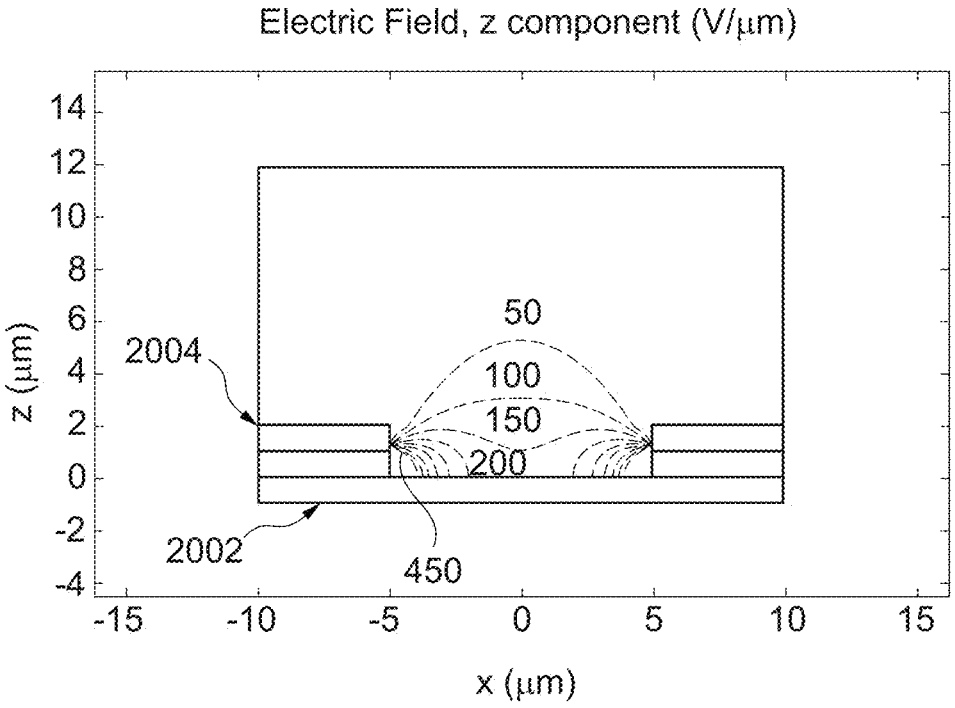

FIGS. 19*b* to 19*d* depict similar simulations with slightly different configurations. More particularly, the distance between the surface 2002 (which always is at 1000 V) and the portion 2004 (which always is at 0 V) with the opening is different for FIGS. 19*b* to 19*d*, namely 5 μm for FIG. 19*b*, 2 μm for FIG. 19*c*, and 1 μm for FIG. 19*d*.

Thus, the z component of the electric field is also changed. In FIG. 19*b*, the lines of constant field also represent multiples of 10, the uppermost one representing 50 V/μm, and the one with the highest value representing 180 V/μm. In FIGS. 19*c*, 19*d*, 20*a*, 20*b*, and 20*c*, the lines of constant field represent multiples of 50, the uppermost one always representing 50 V/μm, and the one with the highest value representing 450 V/μm.

That is, in the vicinity of the surface 2002 (corresponding to the NEMS sensor), the electric field has approximately the following z-components, which is able to desorb particles from a NEMS senor area 1044:

| | Distance between surface 2002 and portion 2004 | z-components of electric field in the vicinity of surface 2002 (approximate) |
|---|---|---|
| FIG. 19b | 5 μm | 140 to 180 V/μm |
| FIG. 19c | 2 μm | 150 to 450 V/μm |
| FIG. 19d | 1 μm | 150 to 450 V/μm |

Figure 20A:
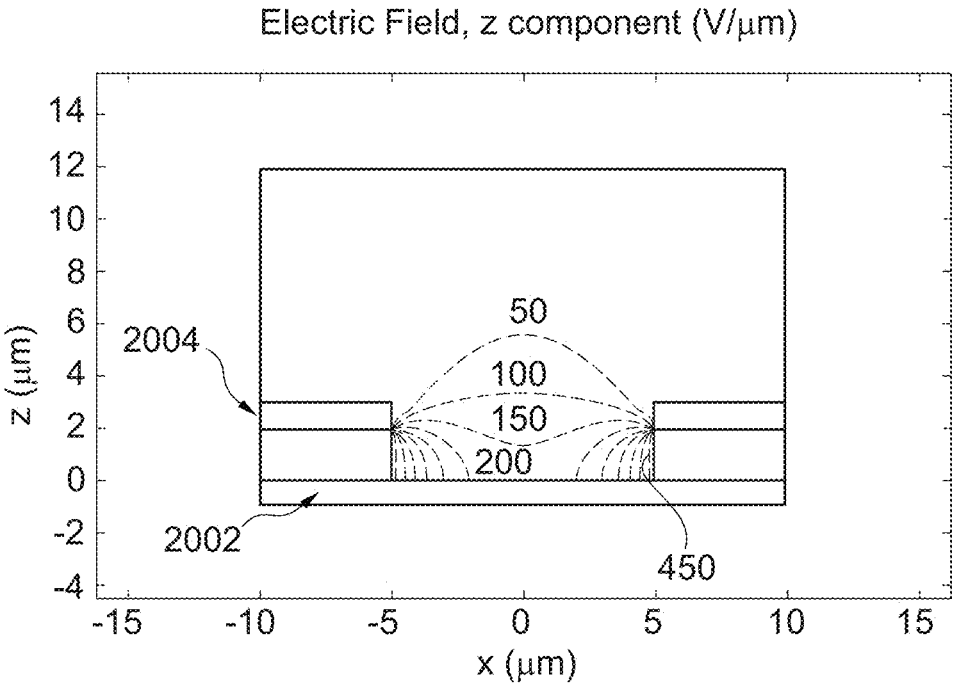
FIGS. 20*a* to 20*c* depict further simulations relating to the electric field generated by a micro lens.
Figure 20B:
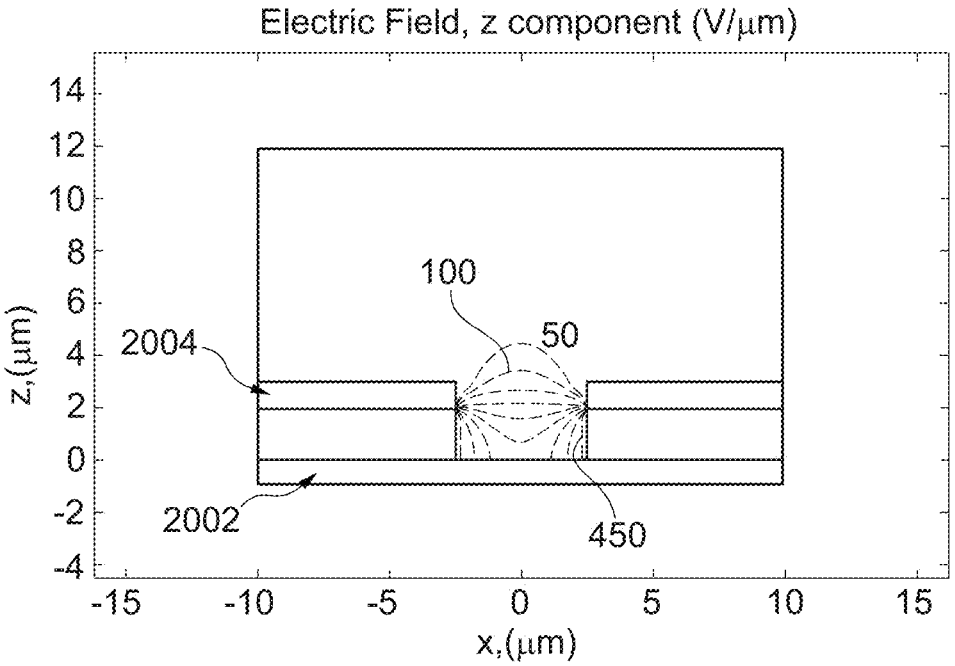
Figure 20C:
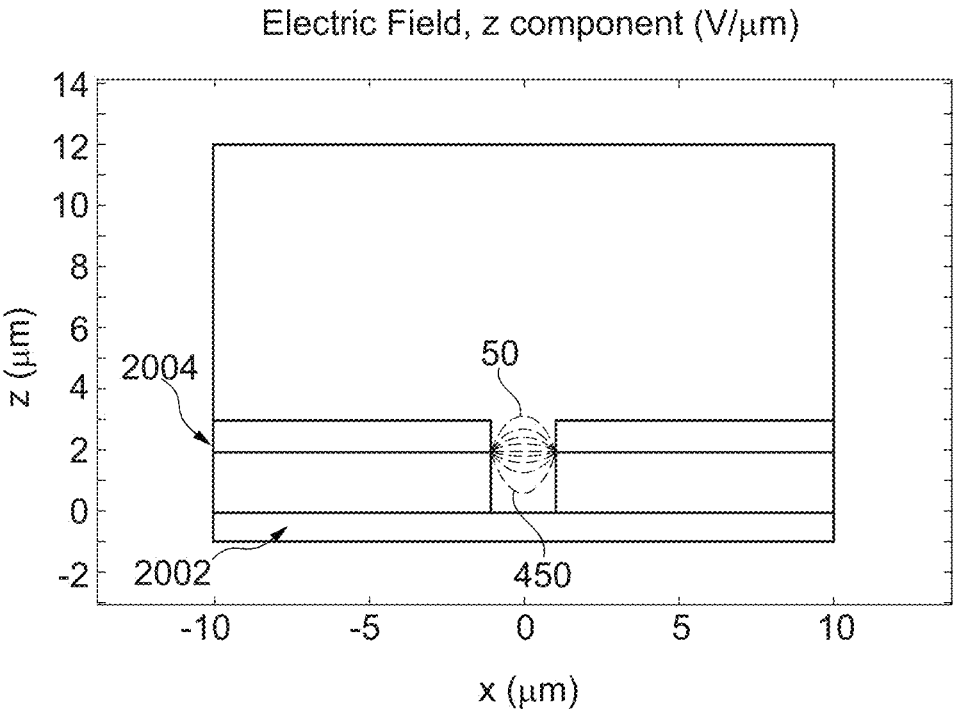

FIGS. 20*a* to 20*c* depict results of simulations generally corresponding to the ones discussed in conjunction with FIGS. 19*a* to 19*d*. Again, all these Figures depict a surface 2002 at a potential of 1000 V and a portion 2004 with an opening, the portion being at an electric potential of 0 V. Portion 2004 is distanced from the surface 2002 by a distance of 2 μm. However, in FIGS. 20*a* to 20*c*, the size of the opening is varied. More particularly, the portion 2004 in FIG. 20*a* comprises an opening 2006 with a size of 10 μm×10 μm, the portion 2004 in FIG. 20*b* comprises an opening 2008 with a size of 5 μm×5 μm, and the portion 2004 in FIG. 20*c* comprises an opening 2010 with a size of 2 μm×2 μm. It will be understood that the configuration depicted in FIG. 20*a* corresponds to the configuration depicted in FIG. 19*c*. Further, it will be understood that generally, the surface 2002 may correspond to a NEMS sensor 104 and that the portion 2004 may correspond to a micro lens 202.

Again, the z-component of the resulting electric field is depicted by electric field lines at corresponding values. In the vicinity of the surface 2002, the following approximate z-components of the electric fields apply:

| | Size of opening 2006 to 2010 | z-components of electric field in the vicinity of surface 2002 (approximate) |
|---|---|---|
| FIG. 20a | $(10\ \mu\text{m})^2$ | 150 to 450 V/μm |
| FIG. 20b | $(5\ \mu\text{m})^2$ | 300 to 450 V/μm |
| FIG. 20c | $(2\ \mu\text{m})^2$ | >450 V/μm |

It will be understood that such values for the electric field may be too high for long-term operation and therefore could be applied only for a short time as nanosecond-long pulses. Such high values of field strengths might be reduced by other means to reduce adhesion, e.g. IR laser for heating or usage of sacrificial layer on the NEMS device with much lower adhesion than ions of analyte (e.g. self-assembled monolayers of polymers).

Figure 21A:
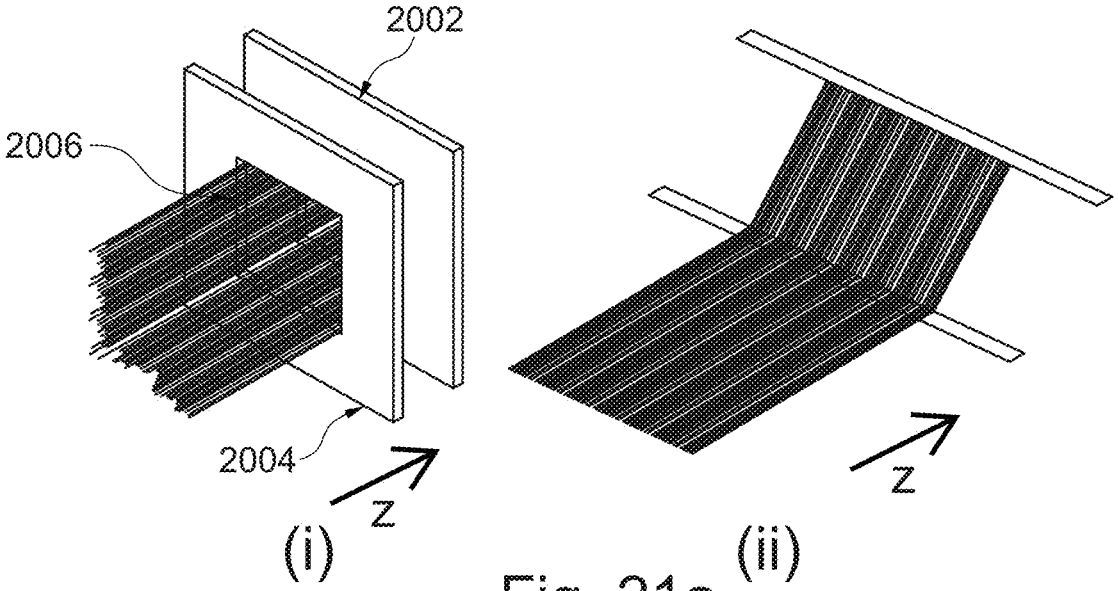
FIGS. 21*a* and 21*b* depict simulations relating to the electric potential generated by the micro lens with trajectories of desorbed ions.
Figure 21B:
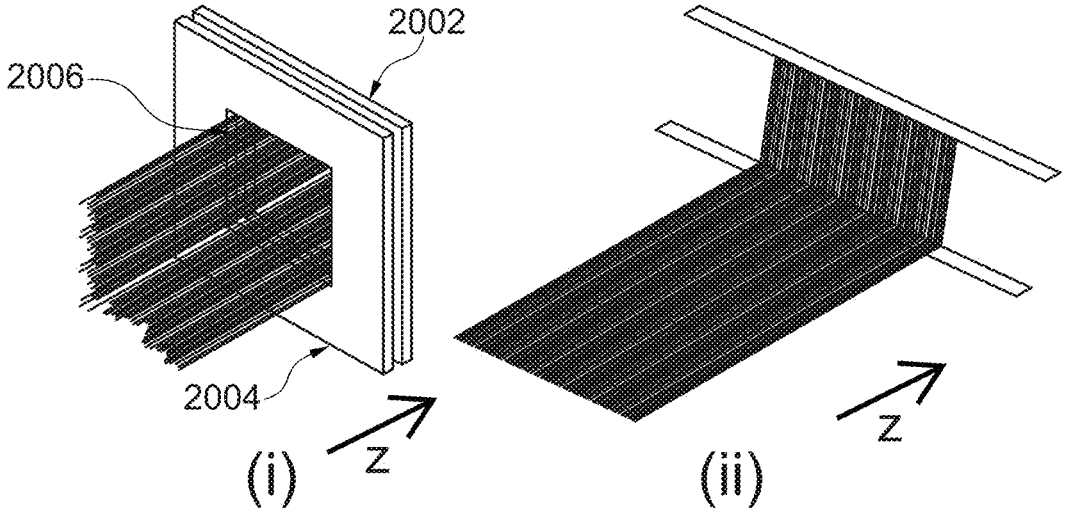

FIG. 21*a* (i) depicts a three-dimensional configuration generally corresponding to the one described above in connection with FIG. 19*a*. Again, there is a surface 2002 (generally corresponding to the NEMS sensor 104 and more particularly corresponding to the NEMS sensor area 1044) and a portion 2004 comprising an opening 2006 (generally corresponding to the micro lens 202) that are distanced with respect to one another. FIG. 21*b* (i) depicts a similar configuration with a smaller distance between the portion 2004 and the surface 2002 (e.g., generally corresponding to the configuration depicted in FIG. 19*c*).

FIGS. 21*a* (ii) and 21*b* (ii) depict general representations of the z-components of the electric potentials corresponding to the configurations depicted in FIGS. 21*a* (i) and 21*b* (i), respectively. As can be seen, the electric potential is substantially uniform up to a point corresponding to the portion 2004 and then increases to the higher electric potential of the surface 2002. If keeping the electric potential of the surface 2002 constant, there will be a sharper increase in the electric potential the smaller the distance is between the surface 2002 and the portion 2004, as can be seen when comparing FIG. 21*a* to FIG. 21*b*. This also leads to a higher electric field—see FIG. 19 in that regard.

Again with reference to FIGS. 19*a* to 20*c* and the previous discussion relating thereto, it can be noted that depending on the exact geometry, the z-component of the electric field in the vicinity of the surface 2002 (corresponding to the NEMS sensor 104) is on the order of several hundred V/μm. Depending on the type of the particles to be analysed and their energy per unit area $\gamma_s$ discussed above, this may be sufficient (see the above equations) to desorb the particles from the NEMS sensor 104. Thus, the present technology allows particles that have impacted the NEMS sensor 104 to be desorbed from it and to be fed to other appliances for further analyses.

Again, with reference to FIG. 21, it is noted that FIGS. 21*a* (i) and 21*b* (i) relate to simulations using the SIMION® software. Particles were assumed to start with a velocity close to 0 at the surface 2002 and then to travel leftwards. As can be seen, the particles identified by the lines in these Figures take an almost uniform and linear path independent of the exact geometry of the configuration.

Figure 22A:
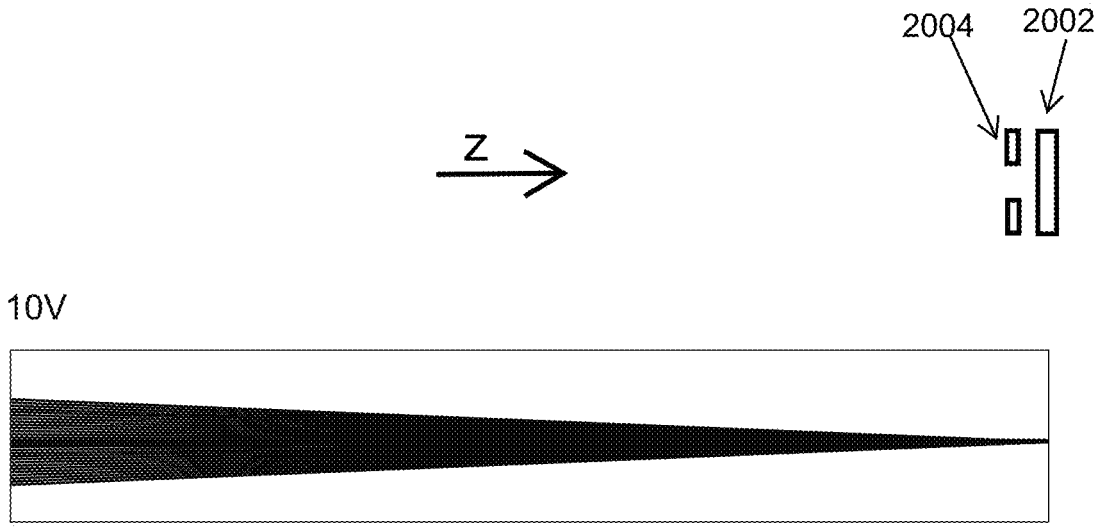
FIGS. 22*a* to 22*c* depict simulations relating to the spread of a group of ions that have been desorbed from the NEMS array using the micro lens in accordance with an embodiment of the present technology.
Figure 22B:
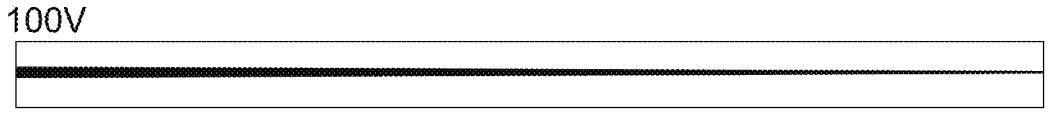
Figure 22C:
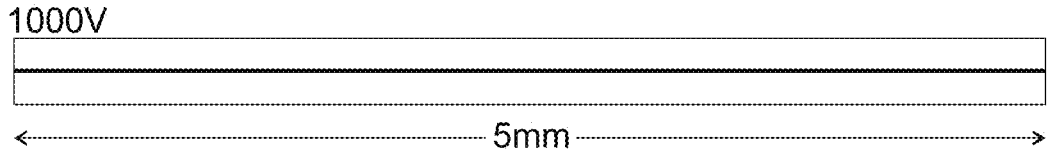

FIG. 22 depicts further details of an ion optics simulation using SIMION®. In all FIGS. 22*a* to 22*c*, an assembly comprising the surface 2002 and the portion 2004 (as in FIG. 21) was simulated to be located on the right side. Desorbed particles fly from this assembly, which may also be referred to as a wafer, to the left. FIGS. 22*a* to 22*c* depict the spread of a group of ions up to 5 mm from the wafer for different voltages.

More particularly, FIG. 22*a* corresponds to a configuration with the surface 2002 being at 10 V, FIG. 22*b* with a voltage of 100 V, and FIG. 22*c* with a voltage of 1000 V relative to the portion 2004 (corresponding to the microlens).

It should be understood that the relative voltage between the surface 2002 (corresponding to the NEMS assembly) and the portion 2004 (corresponding to the microlens) matters. Practically, it may be the micro lens (corresponding to portion 2004) that is lowered in voltage, with 2002 staying around ground for simplicity of NEMS operation.

More particularly, in all of the FIGS. 22*a* to 22*c*, the surface 2002 and the portion 2004 were separated by a distance of 5 μm (not shown with the correct scale in FIGS. 22*a* to 22*c*) and the above described voltages (10 V, 100 V, 1000 V) were applied.

| | Voltage of surface 2002 relative to the portion 2004 | Spot size in 5 mm distance |
|---|---|---|
| FIG. 22a | 10 V | 430 μm |
| FIG. 22b | 100 V | 52 μm |
| FIG. 22c | 1000 V | 14 μm |

It can thus be observed that the spread of the particles i.e. the spot size of the desorbed particles in a distance of 5 mm from the surface of the NEMS sensor 104 is smaller the higher the voltage is.

Furthermore, for a voltage of 10 V, different distances of the portion 2004 from the surface 2002 were assessed, i.e., the spot size of the desorbed particles at a distance of 5 mm was simulated for a distance of 10 μm, 5 μm (as above) and 2 μm. For all these distances, which may also be referred to as electrode spacing, the spot size was 430 μm, i.e., the electrode spacing did not have any measurable effect in the simulations.

In particular at higher voltages, the generated beam thus has diameter below 100 μm facilitating further usage in the system.

Based on the above discussed simulations, it will be understood that the present technology can also be used to desorb particles from the NEMS sensor 104 and focus these particles for further inspection of such particles.

Whenever a relative term, such as "about", "substantially" or "approximately" is used in this specification, such a term should also be construed to also include the exact term. That is, e.g., "substantially straight" should be construed to also include "(exactly) straight".

Whenever steps were recited in the above or also in the appended claims, it should be noted that the order in which the steps are recited in this text may be accidental. That is, unless otherwise specified or unless clear to the skilled person, the order in which steps are recited may be accidental. That is, when the present document states, e.g., that a method comprises steps (A) and (B), this does not necessarily mean that step (A) precedes step (B), but it is also possible that step (A) is performed (at least partly) simultaneously with step (B) or that step (B) precedes step (A). Furthermore, when a step (X) is said to precede another step (Z), this does not imply that there is no step between steps (X) and (Z). That is, step (X) preceding step (Z) encompasses the situation that step (X) is performed directly before step (Z), but also the situation that (X) is performed before one or more steps (Y1), . . . , followed by step (Z). Corresponding considerations apply when terms like "after" or "before" are used.

While in the above, preferred embodiments have been described with reference to the accompanying drawings, the skilled person will understand that this embodiment was provided for illustrative purpose only as examples of the invention and should by no means be construed to limit the scope of the present invention, which is defined by the claims.

The invention can be realized by each embodiment alone or by a combination of several or all features of the described embodiments without any limitations.

The invention claimed is:

1. A system for analyzing particles, the system comprising a NEMS device comprising at least one NEMS sensor for detecting particles impacting the at least one NEMS sensor, each NEMS sensor comprising a NEMS sensor area, a particle lens assembly, the particle lens assembly comprising at least one particle lens for focusing particles onto the NEMS sensor area of the at least one NEMS sensor, wherein the particle lens assembly is spaced from the at least one NEMS sensor area by a separation distance, wherein the system is configured to maintain a space between the particle lens assembly and the NEMS device at a pressure where a mean free path for a reference particle is greater than the separation distance.

2. The system according to claim 1, wherein the at least one NEMS sensor is a plurality of NEMS sensors and wherein the at least one particle lens is a plurality of particle lenses and wherein each particle lens is configured and located to focus particles onto a NEMS sensor associated with the particle lens.

3. The system according to claim 1, wherein the NEMS device is separated from the particle lens assembly by a distance in the range of 1 μm to 20 μm.

4. The system according to claim 1, wherein particles travelling from the particle lens assembly to the NEMS device define a z-direction, and wherein the particle lens assembly has a length along the z-direction, which length is in the range of 50 μm to 500 μm.

5. The system according to claim 1, wherein the system is configured to focus a particle beam onto the at least one NEMS sensor such that at least 50% of particles reaching the NEMS sensor impact the NEMS sensor in an area that is smaller than 20% of a cross-sectional area of the particle lens assembly.

6. The system according to claim 1, wherein the system further comprises a first mass analyzer.

7. The system according to claim 6, wherein the system further comprises a second mass analyzer.

8. The system according to claim 7, wherein the system further comprises:

an ion source for ionizing the particles, an atmosphere-to-vacuum interface to transfer particles from atmospheric pressure to a reduced pressure, an ion storage device, and a collision cell; wherein the atmosphere-to-vacuum interface is located downstream of the ion source;

the ion storage device is located downstream of the atmosphere-to-vacuum interface;

the first mass analyzer is located downstream of the ion storage device, thus defining a first branch downstream of the ion storage device;

the collision cell is located downstream of the ion storage device, thus defining a second branch downstream of the ion storage device;

and the particle lens assembly and the NEMS device are located downstream of the collision cell.

9. The system according to claim 1, wherein the system is configured to maintain the space between the particle lens assembly and the NEMS device at a pressure where a mean free path for the reference particle is more than 5 times greater than the separation distance.

10. The system according to claim 1, wherein the separation distance is in the range of 2 μm to 20 μm.

11. The system according to claim 1, wherein the NEMS sensor area has an area and wherein the quotient of the separation distance and the square root of this area is in the range of 0.5 to 20, preferably 0.7 to 2.

12. A method to analyze particles, comprising:

detecting particles using a NEMS device, the NEMS device including at least one NEMS sensor, each NEMS sensor comprising a NEMS sensor area;

focusing particles onto the NEMS sensor area of the at least one NEMS sensor using a particle lens assembly, the particle lens assembly comprising at least one particle lens, wherein the particle lens assembly is spaced from the at least one NEMS sensor area by a separation distance; and maintaining a space between the particle lens assembly and the NEMS device at a pressure where a mean free path for a reference particle is greater than the separation distance.

13. The method according to claim 12, wherein the focusing of particles comprises at least 50% of particles reaching the NEMS sensor impacting the NEMS sensor in an area that is smaller than 20% of a cross-sectional area of the particle lens assembly.

14. The method according to claim 12, wherein the particle lens assembly further comprises an electrode system comprising a plurality of electrodes, and wherein the method further comprises:

applying a first combination of voltages to the electrodes, resulting in a first focal point on the at least one NEMS sensor area; and applying a second combination of voltages to the electrodes, the second combination of voltages being different from the first combination of voltages, resulting in a second focal point on the at least one NEMS sensor area, the second focal point being spatially shifted relatively to the first focal point.

15. The method according to claim 12, wherein particles travelling from the particle lens assembly to the NEMS device define a z-direction and the particle lens assembly further comprises an electrode system which comprises a plurality of electrodes, and wherein the method further comprises:

applying a voltage combination to the plurality of electrodes and thereby decreasing a velocity of particles along the z-direction.

16. The method according to claim 12, wherein the particle lens assembly further comprises an electrode system which comprises a plurality of electrodes, and wherein the method further comprises:

applying a voltage to the electrodes and thereby removing particles located on the at least one NEMS sensor area.

17. The method according to claim 16, wherein the method further comprises analyzing the particles by an additional instrument different from the NEMS device after removing the particles from the NEMS sensor area, and wherein the additional instrument is a mass analyzer.

18. The method according to claim 12, further comprising:

defining the reference particle; and maintaining the space between the particle lens assembly and the NEMS device at a pressure where a mean free path for the reference particle is more than 5 times greater than the separation distance.

19. The method according to claim 12, further comprising:

altering, using an alignment mechanism, a position of the particle lens assembly relative to the NEMS device, which results in an increase of particles per time reaching the NEMS sensor area.

* * * * *